US005801671A

United States Patent [19]

Kobayashi et al.

[11] Patent Number: 5,801,671

[45] Date of Patent: Sep. 1, 1998

[54] LIQUID CRYSTAL DRIVING DEVICE

[75] Inventors: Masakazu Kobayashi, Osaka; Tatsuya Nakai, Minoo; Hiroyuki Hirashima, Kitakatsurasi-gun; Masahiko Monomohshi; Yoshiki Sano, both of Kashihara, all of Japan

[73] Assignee: Sharp Kabushiki Kaisha, Osaka, Japan

[21] Appl. No.: 630,991

[22] Filed: Apr. 12, 1996

[30] Foreign Application Priority Data

Apr. 12, 1995 [JP] Japan ..... 7-087168

[51] Int. Cl.[6] ..... G09G 3/36

[52] U.S. Cl. ..... 345/95; 345/211; 345/88

[58] Field of Search ..... 345/87, 88, 89, 345/146, 147, 148, 149, 94, 95, 96, 98, 99, 100, 208, 209, 211, 212

[56] References Cited

FOREIGN PATENT DOCUMENTS 57-38497 3/1982 Japan .

*Primary Examiner*—Xiao Wu

[57] ABSTRACT

A liquid crystal display panel 51 of N rows×M columns is driven by a segment driver 52 with two different voltages VS1, VS2, and by a common driver 53 with three voltages VC1, VC2, VC3. An output voltage waveform of the segment driver 52 is modulated for gradation display. The two different voltages VS1, VS2 are selected to be low voltages so as not to require high withstand voltage process in the segment driver 52, which makes it easier to integrated to a large scale in the case of realizing the segment driver 52 as a semiconductor integrated circuit.

30 Claims, 31 Drawing Sheets

| | CONTROL SIGNAL FR= H | CONTROL SIGNAL FR= L |
|---|---|---|
| SELECTIVE LEVEL | GND | VDD |
| NON-SELECTIVE LEVEL | VDD | GND |

| | 1 | 2 | 3 | 4 |
|---|---|---|---|---|
| FRAME 1 | 0 | 0 | 0 | 0 |
| FRAME 2 | 0 | 0 | 0 | 1 |
| FRAME 3 | 0 | 0 | 1 | 1 |
| FRAME 4 | 0 | 1 | 1 | 1 |

LIQUID CRYSTAL DRIVING DEVICE

BACKGROUND OF THE INVENTION

1. Field of the Invention

The present invention relates to a liquid crystal driving device for driving a simple matrix type liquid crystal display panel by time sharing average voltage method.

2. Description of the Related Art

FIG. 19 is a block diagram showing a fundamental structure for driving a simple matrix type liquid crystal display panel 1. The liquid crystal display panel 1 possesses row direction electrodes driven by a common driver 3, corresponding to N columns of scanning lines, and column direction electrodes driven by a segment driver 2, corresponding to M columns of data lines. To display an image on such liquid crystal display panel 1 of N rows×M columns, a common output, for example, as shown in FIG. 20A is applied from the common driver 3 to the scanning lines, and a segment output, for example, as shown in FIG. 20B is applied from the segment driver 2 to the data lines. The common outputs may have four different voltages V1, V2, V5, V6, and the segment outputs may have four different voltages V1, V3, V4, V6.

The liquid crystal display panel 1 in FIG. 19 has a sectional structure as shown in FIG. 21. That is, a liquid crystal member 5 is held between two glass substrates 6, 7, and the structure includes electrodes connected to column direction electrodes 8 and row direction electrodes 9 wired in an orthogonal form. The row direction electrodes 9 are connected to the common driver 3 in FIG. 19, and the column direction electrodes 8 are connected to the segment driver 2 in FIG. 19. A capacitor is composed of the row direction electrodes 9, column direction electrodes 8, and liquid crystal member 5. In the liquid crystal display panel 1, by controlling the effective voltage stored in this capacitor, lighting or non-lighting is controlled. Although the row direction electrodes 8 and the column direction electrodes 9 are provided on the surfaces of the glass substrates 6, 7 not facing the liquid crystal member 5, the row direction electrodes 8 and the column direction electrodes 9 may be provided on the other surfaces of the glass substrates 6, 7 facing the liquid crystal member 5.

FIG. 22 is a plan view for explaining the display action of the liquid crystal display panel 1. In FIG. 22, for the ease of explanation, the construction of the liquid crystal display panel 1 is supposed to be 3 rows×3 columns. Therefore, segment electrodes SEG1, SEG2, SEG3 which are column direction electrodes, and common electrodes COM1, COM2, COM3 which are row direction electrodes are formed in the liquid crystal display panel 1. In the liquid crystal display panel 1 shown in FIG. 22, a shaded region 10 denotes a non-lighting state, and a region 11 shows a lighting state. That is, the intersections of the common electrode COM1 and the segment electrodes SEG1, SEG2, the intersection of the common electrode COM2 and the segment electrode SEG3, and the intersection of the common electrode COM3 and the segment electrode SEG2 are in lighting state, and the intersection of the common electrode COM1 and the segment electrode SEG3, the intersections of the common electrode COM2 and the segment electrodes SEG1, SEG2, and the intersections of the common electrode COM3 and the segment electrodes SEG1, SEG3 are in non-lighting state.

FIG. 23 is a waveform diagram of a voltage applied to each electrode for driving the liquid crystal display panel 1 shown in FIG. 22. FIG. 23 shows the waveform of a voltage applied to the common electrodes COM1, COM2, COM3, the waveform of the voltage applied to the segment electrodes SEG1, SEG2, SEG3, and a control signal FR. The control signal FR is described later. When the control signal FR is of high level, the voltage V1 is applied to the common electrodes COM sequentially, and the voltage V5 is applied to a common electrode to which the voltage V1 is not applied. When the control signal FR is of low level, the voltage V6 is applied to the common electrodes COM sequentially, and the voltage V2 is applied to a common electrode to which the voltage V6 is not applied. Moreover, when the control signal FR is of high level, the voltage V6 as ON voltage for lighting the intersection is applied to the segment electrodes SEG, and the voltage V4 is applied as OFF voltage for not lighting the intersection. When the control signal FR is of low level, the voltage V1 as ON voltage for lighting the intersection is applied to the segment electrodes SEG, and the voltage V3 is applied as OFF voltage for not lighting the intersection. The waveform of the voltage applied to the liquid crystal member 5 is a waveform synthesizing the voltages applied to the electrodes.

FIG. 24A shows a voltage waveform applied to the liquid crystal member 5 in lighting state, and FIG. 24B shows a voltage waveform applied to the liquid crystal member 5 in non-lighting state. In FIG. 24A and FIG. 24B, the output from the common driver 3 is indicated by a solid line, and the output from the segment driver 2 is indicated by broken line. The potential difference of the non-selective voltages V2, V5 applied to the common electrodes COM and the voltages V1, V3, V4, V6 applied to the segment electrodes SEG shown in FIG. 24B is respectively supposed to be a voltage VB, and the potential difference of the selective voltages V1, V6 applied to the common electrodes COM and voltages V6, V1 applied to the segment electrodes SEG shown in FIG. 24A to be VA. When a non-selective voltage is applied to the common electrode COM, the voltage of combined waveform is always the voltage VB, and nothing is lit up. When a selective voltage is applied to the common electrode COM, the intersection lights up where the voltage of combined waveform is voltage VA.

As shown in FIG. 25, the liquid crystal molecules 13 composing the liquid crystal member 5 are in an elliptical form as seen from the side, and are characterized to have polarity when receiving a voltage in a same direction always from one direction, and maintain the same direction if voltage application is stopped. Accordingly, to invert the positive and negative polarity by periodically changing the voltage direction, it is necessary to invert the potential relation periodically between the common side and segment side in synchronism with the control signal FR as shown in FIGS. 20A, 20B, 23, 24A, and 24B. The control signal FR is a signal for defining a timing when the polarity of the voltage applied to the liquid crystal molecules 13 is periodically changed. In such driving system, when determining the effective voltage at orthogonal intersection of the common side electrode line and segment side electrode line of the liquid crystal, it is obtained as shown in formulas 1 and 2:

$$V_{ON}\text{ (effective voltage when lighting)} = \sqrt{\left\{\frac{(VA+VB)^2\times t + VB^2\times(T-t)}{T}\right\}} \quad (1)$$

-continued $V_{OFF}$ (effective voltage when put out) = (2)

$$\sqrt{\left\{ \frac{(VA+VB)^2 \times t + VB^2 \times (T-t)}{T} \right\}}$$

where T=N×t. Herein, N is the number of scanning side (common side) electrodes, and t is the time. The lighting and non-lighting effective voltages are expressed in formulas (1) and (2), and when formula (3) is established, the contrast ratio of $V_{ON}/V_{OFF}$ reaches the maximum of (√N+1)/(√N−1).

$$VA = \sqrt{N \times VB} \quad (3)$$

Usually, the relation of the voltages VA and VB for satisfying formula (3) is determined, and the following formulas (4) and (5) are established when the threshold voltage $V_{TH}$ of the liquid crystal is exactly $V_{OFF}$ as shown in FIG. 26. From voltage VA to VB, the phase of the liquid crystal is inverted.

$$VA = V_{TH} \times \sqrt{\left\{ \frac{N \times \sqrt{N}}{2 \times \sqrt{(N-1)}} \right\}} \quad (4)$$

$$VB = V_{TH} \times \sqrt{\left\{ \frac{\sqrt{N}}{2 \times \sqrt{(N-1)}} \right\}} \quad (5)$$

Therefore, when the voltages VA and VB satisfy the relation of formulas (4) and (5), the liquid crystal display state can be controlled by the common and segment output voltages. This relation is, however, theoretical, and the waveform may go out of the theory in part when displaying by actually driving the liquid crystal display panel 1. For example, as shown in FIG. 27, when the segment output waveform is magnified, the theoretical rectangular waveform indicated by solid line coincides with the result indicated by the formula above, but actually, as shown by broken line, the waveform may be dull due to capacitance component and resistance component. In this case, as N increases, that is, as the screen becomes wider, the effective components of dull waveform increase, and ghost or the like may occur to deteriorate the display quality.

In such prior art, the common driver 3 and segment driver 2 are driving the liquid crystal display panel 1 by using four different voltages respectively, but Japanese Unexamined Patent Publication JPA 57-38497 discloses a constitution of monochromatic display by driving the segment side with two different voltages and the common side with three different voltages.

In a typical prior art for gradation display, as shown in FIG. 28, four voltages are used each at the segment electrode side and common electrode side, and gradation display is realized by modulating the waveform of the output voltage at the segment electrode side. In the prior art shown in FIG. 28, the liquid crystal display panel 1 is driven in matrix by the segment driver 2 and common driver 3. The segment driver 2 drives the column electrodes of the liquid crystal display panel 1 by the four voltages V1, V3, V4, V6. The common driver 3 drives the line electrodes of the liquid crystal display panel 1 by the four voltages V1, V2, V5, V6. Of the driving voltages of the segment driver 2 and common driver 3, the highest voltage V1 and the lowest voltage V6 are commonly used in the two drives 2, 3, and therefore a driving voltage generating circuit 15 generates the six voltages V1, V2, V3, V4, V5, V6.

A liquid crystal display device 16 comprises the liquid crystal display panel 1, segment driver 2, common driver 3, and driving voltage generating circuit 15. The liquid crystal display device 16 operates according to the signal given from an external controller 20 to the segment driver 2 and the common driver 3. The controller 20 is directly coupled with a RAM (random access memory) 21 for display which stores the image data to be displayed by the liquid crystal display panel 1, and is connected to a CPU (central processing unit) 23, RAM 24, ROM (read only memory) 25, gate array 26, and peripheral I/O (input/output) 27 through a data bus 22.

FIG. 29A is a block diagram showing a structure of the segment driver 2, and FIG. 29B is a waveform diagram for explaining the operation of the segment driver 2. FIG. 29A and FIG. 29B relate to an example of display in 16 gradations by four-bit data. Four-bit input data D0 to D3 are read into a data latch 31. When data for the portion of one horizontal scanning line is read, it is read into a four-bit line latch 32 in batch in synchronism with a latch pulse LP. On the basis of the four-bit data read in the line latch 32, one of fundamental signals S0 to S15 having 16 types of pulse width is selected by a gradation decoder 33. The selected fundamental signal S is fed into a liquid crystal driving output circuit 34 to which the four levels of voltages V1, V3, V4, V6 are applied. By the fundamental signal S, the output Yi of the liquid crystal driving output circuit 34 is delivered in variable pulse width. The output Yi is applied to the segment electrode which is a column direction electrode of the liquid crystal display panel 1.

FIG. 30A is a waveform diagram showing a common output waveform when driving the liquid crystal display panel 1, FIG. 30B is a waveform diagram showing a segment output waveform when driving the liquid crystal display panel 1, and FIG. 30C is a waveform diagram showing a combined waveform of common and segment. The common driver 3 selects and outputs the four voltages V1, V2, V5, V6, and when lighting the liquid crystal, voltage V1 or V6 is delivered. The segment driver 2 selects and outputs the four voltages V1, V3, V4, V6, and also outputs the voltages V1, V6 only for the period indicated by the input data D0 to D3. As shown in FIG. 30C, when the liquid crystal lights, either voltage V1 or V6 is applied to the common electrode and segment electrode. At this time, as the pulse width of the output voltage of the segment electrode side is changed, the gradation display is realized.

FIG. 31 is a waveform diagram magnifying part of the combined waveform shown in FIG. 30C. Herein, supposing the voltages V1, V2, V3, V4, V5, V6 to be sequentially 26 V, 24 V, 22 V, 4 V, 2 V, 0 V, the voltage VH applied to the liquid crystal member 5 in lighting state is 26 V. In the above prior art, the voltage applied to the segment driver 2 changes to 26 V when changing most, and the voltage applied to the common driver 3 is changed to 24 V when changed most.

Both segment driver 2 and common driver 3 are accompanied by voltage changes of large amplitude, and the portion A changing the pulse width Pw shown in FIG. 31 is large in dullness of the waveform as magnified in FIG. 32. In FIG. 32, the ideal waveform is indicated by double dot chain line, and the actual waveform is shown by broken line. For example, in FIG. 32, it is attempted to display 8/16 gradations, but the waveform is dull and the result is 4/16 gradations.

As a method of realizing gradation display, the pulse width modulation method is explained, but other methods of realizing gradation display include pulse amplitude modulation, pulse number modulation, and frame decimation.

FIG. 33 is a block diagram showing the constitution of a segment driver 2a for gradation display by pulse amplitude modulation. Same as the segment driver 2 shown in FIG. 28, display of 16 gradations by the four-bit input data D0 to D3 is explained. In the segment driver 2a, same constituent elements as in the segment driver 2 are indicated by same reference numerals, and their explanations are omitted. In the liquid crystal display apparatus 16 shown in FIG. 28, the segment driver 2a is used in lieu of the segment driver 2.

A gradation decoder 36 gives a selection signal to a liquid crystal driving output circuit 37 on the basis of the data read in the four-bit line latch 32. In the liquid crystal driving circuit 37, a voltage having 16 types of amplitude is applied from a reference voltage generating circuit 38 for gradation. The liquid crystal driving output circuit 37 selects a voltage of any amplitude by the selection signal from the gradation decoder 36, and produces as output Yi. The output Yi changes its amplitude depending on the gradation. This amplitude change is effected by selecting the level dividing the voltage in 16 divisions, from the voltage V1 to the voltage V3, or from the voltage V4 to the voltage V6.

In the case of gradation display by pulse number modulation, in the same constitution as in the segment driver 2a shown in FIG. 33, 16 pulse signals are outputted from the reference voltage generating circuit 38 for gradation in the period of one frame. The liquid crystal driving output circuit 37 selectively produces the pulse signal in the number equal to the number of gradations specified by the input data D0 to D3 as output Yi.

FIG. 34A is a display table for displaying in four gradations by frame decimation, and FIG. 34B shows one frame selected at every gradation. Two-bit input data is read into two-bit data latch, and after reading data for one scanning line, it is read into the two-bit line latch in batch in synchronism with the latch pulse LP. From the two-bit data read into the line latch, the outputs are alternately changed over in one period of four frames according to the display table shown in FIG. 34A, thereby realizing four-gradation display as shown in FIG. 34B.

As the liquid crystal display panel becomes larger in screen size, the time capable of applying a display voltage in one line becomes shorter, and consequently the effective voltage per pixel becomes lower, which gives rise to need of high voltage driving. The liquid crystal driving voltage by the duty driving method which is the time sharing average voltage method is expressed in formula (6).

$$\text{Liquid crystal driving voltage} = (\sqrt{N+1}) \times V_{TH} \quad (6)$$

Supposing, for example, the number of rows N to be 144, and the threshold voltage $V_{TH}$ of the liquid crystal to be 2 V, the liquid crystal driving voltage is 26 V. According to formula (6), in the large screen increased in the number of rows N, a greater driving voltage is needed. In other words, at the same driving voltage, when driving a liquid crystal display panel of a larger screen size, the time capable of applying a display voltage per line is shorter, and the effective voltage is smaller.

As the effective voltage becomes smaller, a sufficient display contrast cannot be obtained, and it is required to heighten the driving voltage, but to cope with high voltage, the semiconductor integrated circuit can be manufactured by using high withstand voltage process in the segment drive 2, common driver 3, and peripheral circuits. In the high withstand voltage process, in particular, the transistor size of the output buffer unit is larger, and the chip size of the semiconductor integrated circuit increases, which may lead to increase of cost.

From the viewpoint of quality of image display, as explained in the example of pulse width modulation, the waveform dullness increases at the time of change of output level, and switching noise is likely to occur due to change of output level, and uneven luminance is likely to occur.

To realize smaller size and lower cost of display device, moreover, it is required to promote LSI for increasing the scale of semiconductor integrated circuit, but if a withstand voltage manufacturing process is used in a driver for display, it is difficult to compound the driver for display and other peripheral LSI. As the LSI promotion is difficult, the wiring distance is extended, and the floating capacity increases, and hence it is hard to increase the speed.

SUMMARY OF THE INVENTION

It is hence an object of the invention to present a liquid crystal driving device capable of integrating a driving circuit to a large scale, being capable of driving unidirectional electrodes of display panel of simple matrix type for gradation display, by using a low voltage driving circuit not requiring high withstand voltage process.

The invention provides a liquid crystal driving device for driving liquid crystal of a simple matrix type liquid crystal display panel having segment side and common side electrodes disposed in two directions orthogonal to each other, by time sharing average voltage method using a semiconductor integrated circuit, comprising:

- a low voltage driving circuit for driving electrodes arranged in one direction on the basis of two predetermined different voltages VS1, VS2,
- a high voltage driving circuit for driving electrodes arranged in another direction on the basis of three predetermined different voltages VC1, VC2, VC3, wherein the voltages VC1, VC3 are respectively the highest and the lowest among the three voltages VC1, VC2, VC3, and the absolute value of potential difference of the highest voltage VC1 and the lowest voltage VC3 is greater than the absolute value of potential difference of the two voltages VS1, VS2, and the intermediate voltage VC2 is set as a voltage between the two voltages VS1 and VS2, and
- a modulation circuit for modulating the output voltage waveform from the low voltage driving circuit according to a signal for gradation display.

In the invention, the two voltages VS1, VS2 are set in a range between a supply voltage VDD and a grounding voltage GND of a standard logic semiconductor integrated circuit element.

In the invention, the low voltage driving circuit drives the segment side electrodes, and the high voltage driving circuit drives the common side electrodes.

In the invention, the modulation circuit modulates the output voltage waveform in pulse width.

In the invention, the modulation circuit comprises:

- pulse signal generating means for generating pulse signals of different widths in the same number as the maximum number of gradations that can be specified by the gradation display signal,
- pulse signal selecting means for selecting a pulse signal of the width corresponding to a gradation specified by the gradation display signal, and
- output means for outputting the voltages VS1, VS2 on the basis of a pulse signal selected by the pulse signal selecting means.

In the invention, the modulation circuit modulates the output voltage waveform in amplitude.

In the invention, the modulation circuit comprises:

voltage generating means for dividing from the voltage VS1 to the voltage VS2 by predetermined rates, and generating voltages of different widths in the same number as the maximum number of gradations that can be specified by the gradation display signal, and voltage selecting means for selecting and outputting a voltage of a width corresponding to the gradation specified by the gradation display signal.

In the invention, the modulation circuit modulates the output voltage waveform by a method of adjusting the number of pulses as a set of pulses.

In the invention, the modulation circuit comprises:

pulse signal output means for outputting pulse signals of a predetermined width in the same number as the maximum number of gradations that can be specified by the gradation display signal, in a frame period necessary for applying predetermined voltages sequentially to all of the electrodes arranged in one direction in the display panel, and output means for selecting pulse signals in the same number as the number of gradations specified by the gradation display signal, out of the pulse signals outputted from the pulse signal output means in the frame period, outputting either one of the voltages VS1, VS2 in the periods of the predetermined width of the pulse signals, and outputting the other voltage in other periods than the predetermined width of the pulse signals.

In the invention, the modulation circuit modulates the output voltage waveform by frame decimation method.

In the invention, the modulation circuit comprises:

voltage output means for out putting either one of the voltages VS1, VS2 in every frame period necessary for applying predetermined voltages sequentially to all of the electrodes arranged in one direction of the display panel, and output means for determining a reference frame period including a frame period in the same number as the maximum number of gradations that can be specified by the gradation display signal, and determining the voltage in each frame period within the reference frame period, on the basis of the number of gradations specified by the gradation display signal.

In the invention, the low voltage driving circuit is formed to include a display memory for temporarily storing the gradation display signal for making gradation display on the display panel.

In the invention, the low voltage driving circuit is formed to include a processing device for controlling the low and high voltage driving circuits.

In the invention, the low voltage driving circuit is formed to include a gate array formed of semiconductor elements for performing a predetermined function.

According to the invention, the lighting state and non-lighting state of the liquid crystal display are changed over by combination of the two output voltages VS1, VS2 from the low voltage driving circuit, and three output voltages VC1, VC2, VC3 from the high voltage driving circuit. It is the lighting state when the highest voltage VC1 of the three voltages VC1, VC2, VC3 and the lower voltage VS2 of the two voltages VS1, VS2 are combined, or when the lowest voltage VC3 of the three voltages VC1, VC2, VC3 and the higher voltage VS1 of the two voltages VS1, VS2 are combined. In all other cases, it is the non-lighting state. The low voltage driving circuit is formed without resort to high withstand voltage process, and it can be formed in a smaller buffer size, and therefore by decreasing the chip size of the semiconductor integrated circuit, the cost can be reduced. The modulation circuit modulates the output voltage waveform of the low voltage driving circuit, and when modulation for gradation display may be done easily.

Also according to the invention, the two voltages VS1, VS2 are set in a range between the supply voltage VDD and grounding voltage GND of a standard logic semiconductor integrated circuit element, and therefore the low voltage driving circuit can be manufactured in the same process as a standard logic semiconductor integrated circuit element, and can be electrically connected with a logic semiconductor integrated circuit element.

Also according to the invention, since the segment side electrode is driven by the low voltage driving circuit and the common side electrode is driven by the high voltage driving circuit, the output voltage waveform for driving the segment side electrodes of low voltage can be easily modulated, and gradation display may be realized.

Also according to the invention, out of pulse signals of different width generated by the pulse signal generating means, one is selected by a gradation display signal, and either of voltages VS1, VS2 is outputted depending on the selected pulse signal. Therefore, in the period corresponding to the gradation specified by the gradation display signal, either of voltages VS1, VS2 is outputted, and in other period, hence, the other voltage is outputted, so that gradation display by pulse width modulation is realized.

Also according to the invention, out of voltages of different amplitudes between the voltages VS1, VS2 generated by the voltage generating means, one is selected and outputted by the gradation display signal, so that gradation display by amplitude modulation is realized.

Also according to the invention, the pulse signal output means outputs pulse signals in the same number as the maximum number of gradations that can be specified by the gradation display signal in one frame period, selects pulse signals in the same number as the number of gradations specified by the gradation display signal, and outputs either of the voltages VS1, VS2 according to the signal level of the pulse signal, so that gradation display is realized by the number of pulses selected in the frame period.

Also according to the invention, the frame period in the same number as the maximum number of gradations that can be specified by the gradation display signal is the reference frame period, and the voltage in each frame period is determined by the number of gradations specified by the gradation display signal, and therefore the voltage level is determined in each frame period in the reference frame period, and gradation display is made.

Also according to the invention, since the display memory is included in the low voltage driving circuit, the composition of the display memory may be easily optimized according to the composition of the liquid crystal display panel, so that high speed display drive without time delay is realized.

Furthermore, according to the invention, since a processing unit such as a CPU is included in the low voltage driving circuit, image processing of display content by the liquid crystal display panel can be made at the same time.

Also according to the invention, since the gate array is included in the low voltage driving circuit, various specifications can be realized according to the request of the user by using the liquid crystal display device of a same design.

In this way, according to the invention, since the electrodes arranged in one direction of the segment side and common side electrodes arranged in two mutually orthogonal directions of the simple matrix type liquid crystal display panel are driven on the basis of two output voltages VS1, VS2 from the low voltage driving circuit constructed without resort to high withstand voltage process, it is possible to integrate to a large scale as semiconductor integrated circuit, and the cost can be reduced. Moreover, since the output voltages of the high voltage driving circuit for driving the electrodes arranged in the other direction are the three voltages VC1, VC2, VC3, the number of supply voltages for liquid crystal display can be decreased on the whole, so that the current consumption may be lowered.

Also according to the invention, since the two voltages VS1, VS2 are set in a range between the supply voltage VDD and grounding voltage GND of a standard logic semiconductor integrated circuit element, high integration can be achieved by applying the widely employed manufacturing process of semiconductor integrated circuit, while high speed operation is realized at the same time.

Also according to the invention, since the low voltage driving circuit drives the segment side electrodes, the segment driver can be integrated to a large scale, and it is particularly advantageous when increasing the number of pixels per scanning line.

Also according to the invention, since the modulation circuit modulates the output waveform of the low voltage driving circuit by pulse width, it is possible to reduce the uneven luminance due to waveform dullness occurring at the time of pulse width modulation.

Also according to the invention, since the modulation circuit modulates the output voltage of the low voltage driving circuit by amplitude, gradation display is possible in a state less affected by noise or other effects.

Also according to the invention, since the modulation circuit adjusts the number of pulses of a set as pulses of the output voltage of the low voltage driving circuit, gradation display can be made in a state small in waveform dullness or noise generation.

Also according to the invention, since the modulation circuit displays gradations by modulating the output waveform of the low voltage driving circuit by frame decimation method, gradation display is made in a state free from lowering of display quality due to waveform dullness or noise generation.

Also according to the invention, since the display memory is included in the low voltage driving circuit, the liquid crystal driving device can be integrated to a large scale, and smaller size and higher performance can be achieved on the whole.

Also according to the invention, since the low voltage driving circuit includes the CPU, the function is enhanced in the entire liquid crystal driving device.

Also according to the invention, since the low voltage driving circuit includes the gate array, it can be easily suited sufficiently to various uses required in the liquid crystal display device.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
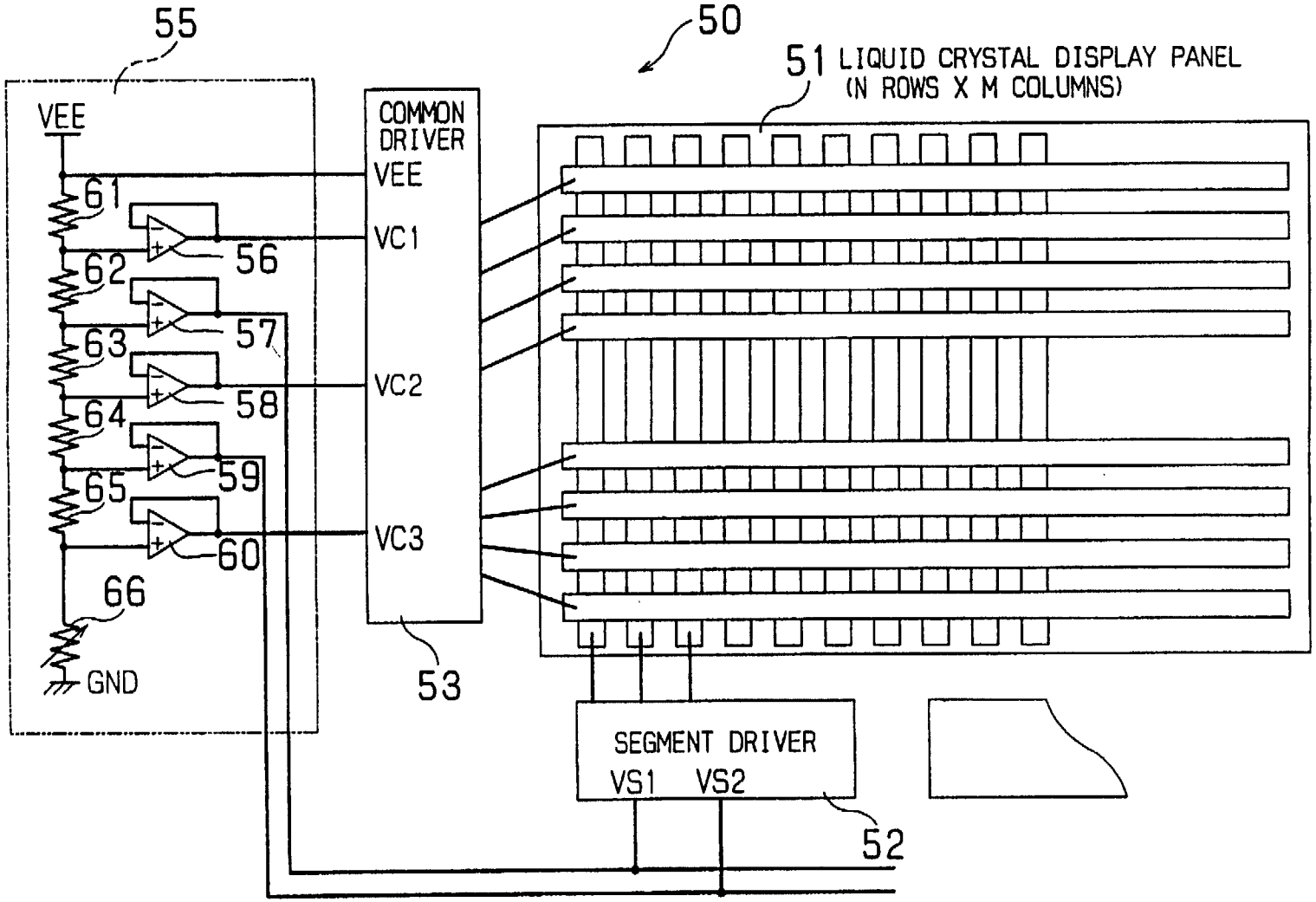
FIG. 1 is a block diagram showing an electric structure of a first embodiment of the invention.

Now referring to the drawings, preferred embodiments of the invention are described below.

FIG. 1 is a block diagram showing an electric structure of a liquid crystal display device 50 including liquid crystal driving devices in a first embodiment of the invention. The liquid crystal display device 50 is composed of a segment driver 52 and a common driver 53 which are liquid crystal driving devices, a liquid crystal display panel 51, and a voltage source circuit 55.

The liquid crystal display panel 51 is a display panel of simple matrix type of N rows×M columns, and column direction electrodes are driven by the segment driver 52, and row direction electrodes are driven by the common driver 53. The voltage source circuit 55 applies a voltage for driving the column direction and row direction electrodes to the segment driver 52 and common driver 53. The voltage source circuit 55 divides down the voltage by resistors 61 to 65 and a variable resistor 66 connected in series sequentially from the high voltage side in a range from the supply voltage VEE for display to the grounding voltage GND, and produces the voltages VC1, VS1, VC2, VS2, VC3 through buffers 56 to 60. The relation of these five voltages is as shown in formula (7).

$$VEE>VC1>VS1>VC2>VS2>VC3 \quad (7)$$

In the common driver 53, the four voltages VEE, VC1, VC2, VC3 are applied, and the row direction electrodes are driven by three voltages of them, VC1, VC2, VC3. In the segment driver 52, the two different voltages VS1, VS2 are applied, and the column direction electrodes are driven.

Figure 2A:
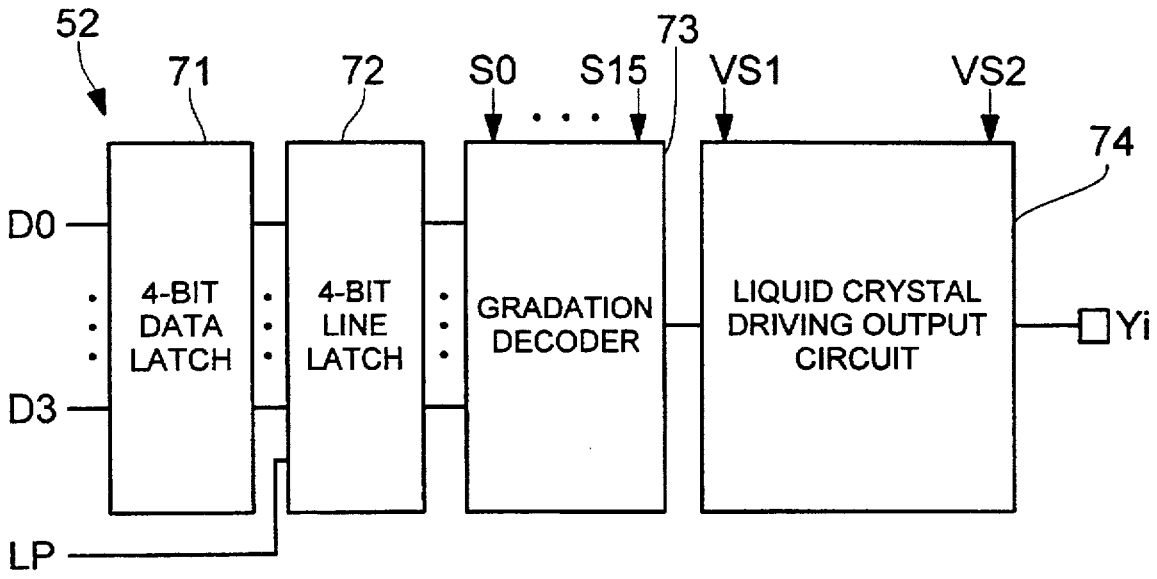
FIG. 2A is a block diagram showing a structure of a segment driver 52.
Figure 2B:
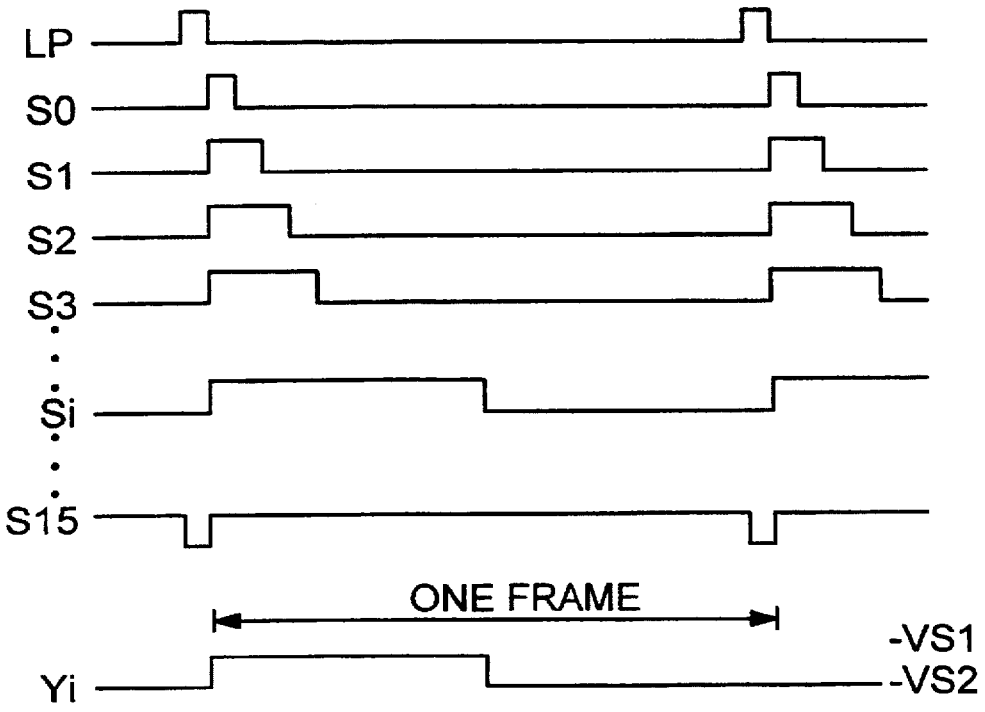
FIG. 2B is a waveform diagram for explaining the operation of the segment driver 52.
Figure 29A:
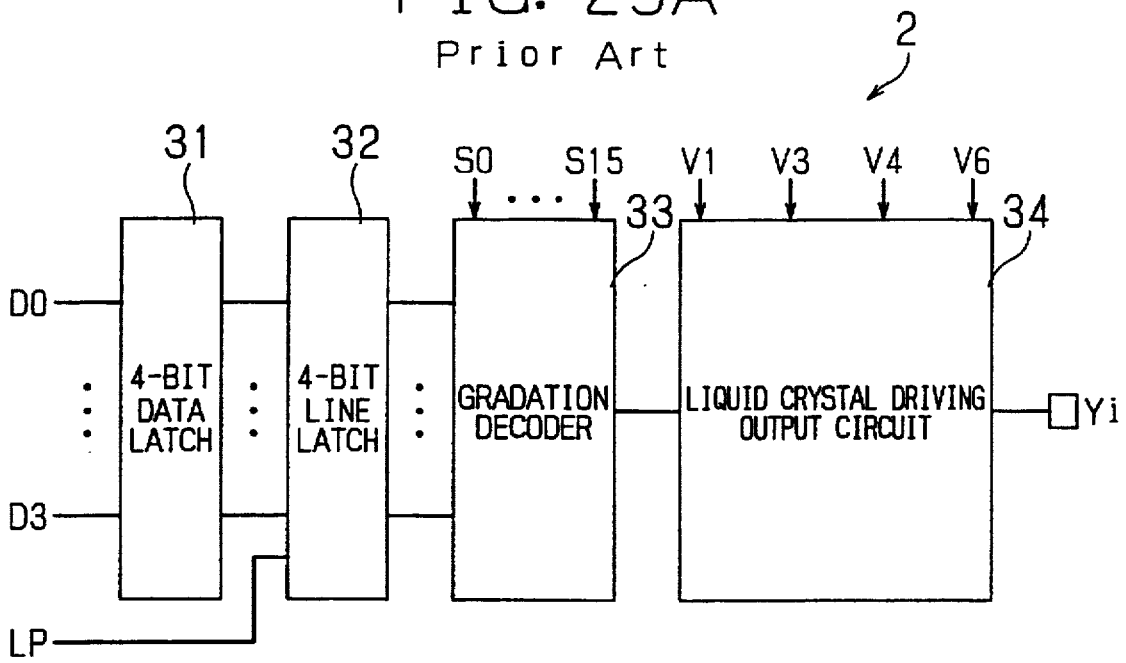
FIG. 29A Prior Art
FIG. 29A is a block diagram showing a structure of segment driver 2 for pulse width modulation.
Figure 29B:
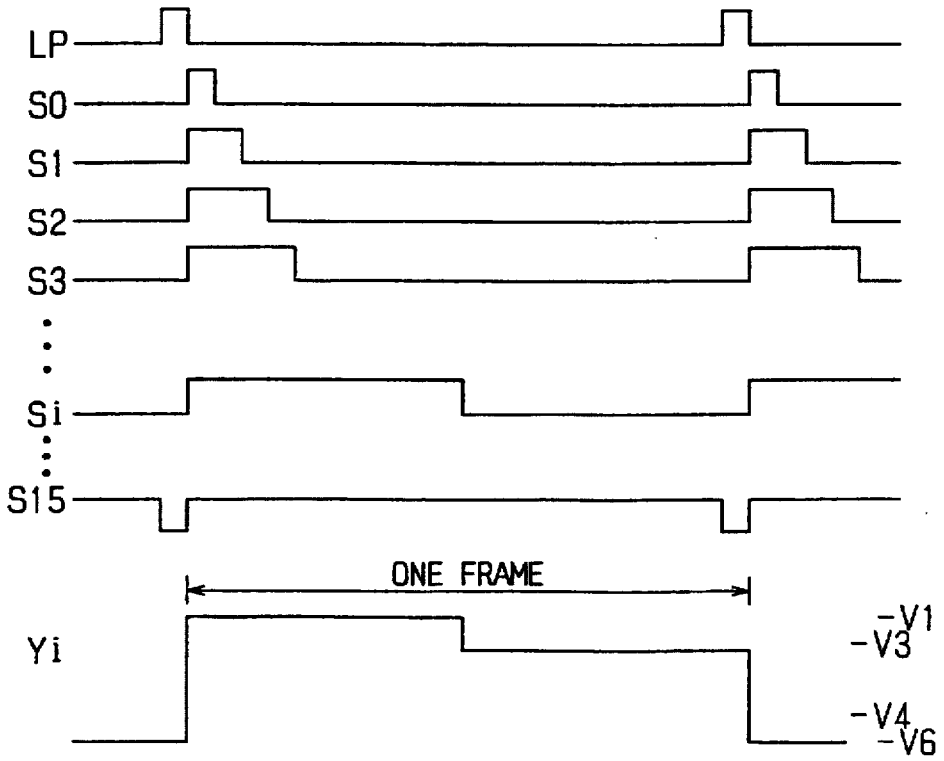
FIG. 29B is a waveform diagram for explaining the operation of segment driver 2 for making pulse width modulation.
Figure 30A:
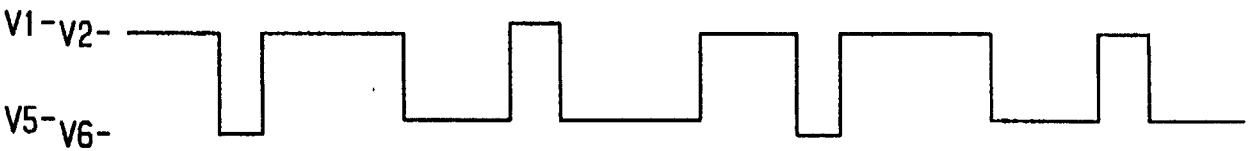
FIG. 30A Prior Art
FIG. 30A is a waveform diagram showing an output voltage from the common driver 3.
Figure 30B:
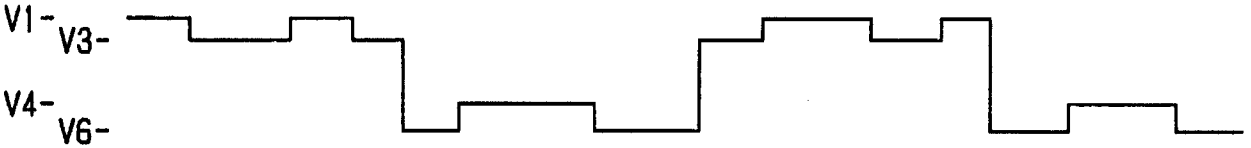
FIG. 30B Prior Art
FIG. 30B is a waveform diagram showing an output voltage from the segment driver 2.
Figure 30C:
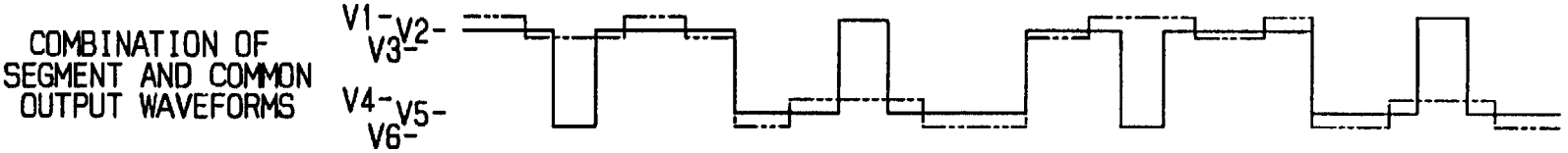
FIG. 30C Prior Art
FIG. 30C is a waveform diagram combining output voltage waveforms in FIG. 30A and FIG. 3OB.
Figure 31:
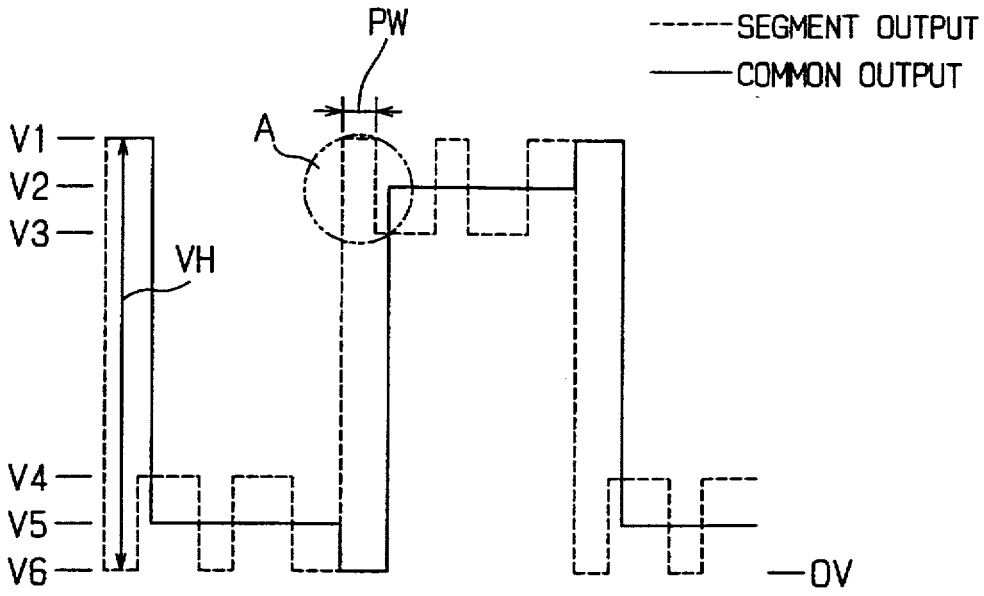
FIG. 31 Prior Art
FIG. 31 is a waveform diagram showing the portion of two frames of the combined waveform shown in FIG. 3OC.
Figure 32:
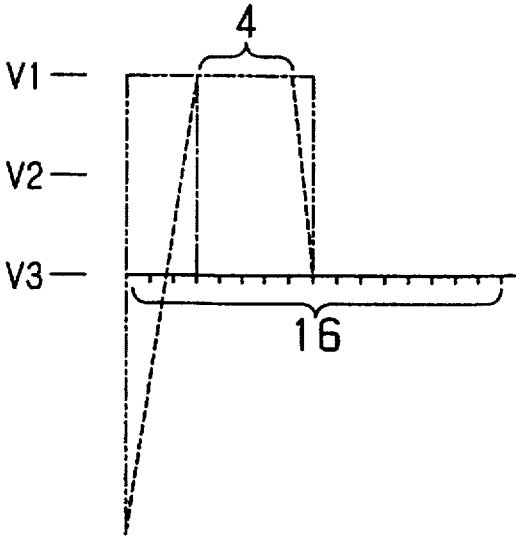
FIG. 32 Prior Art
FIG. 32 is a magnified waveform diagram showing region A in FIG. 31.
Figure 33:
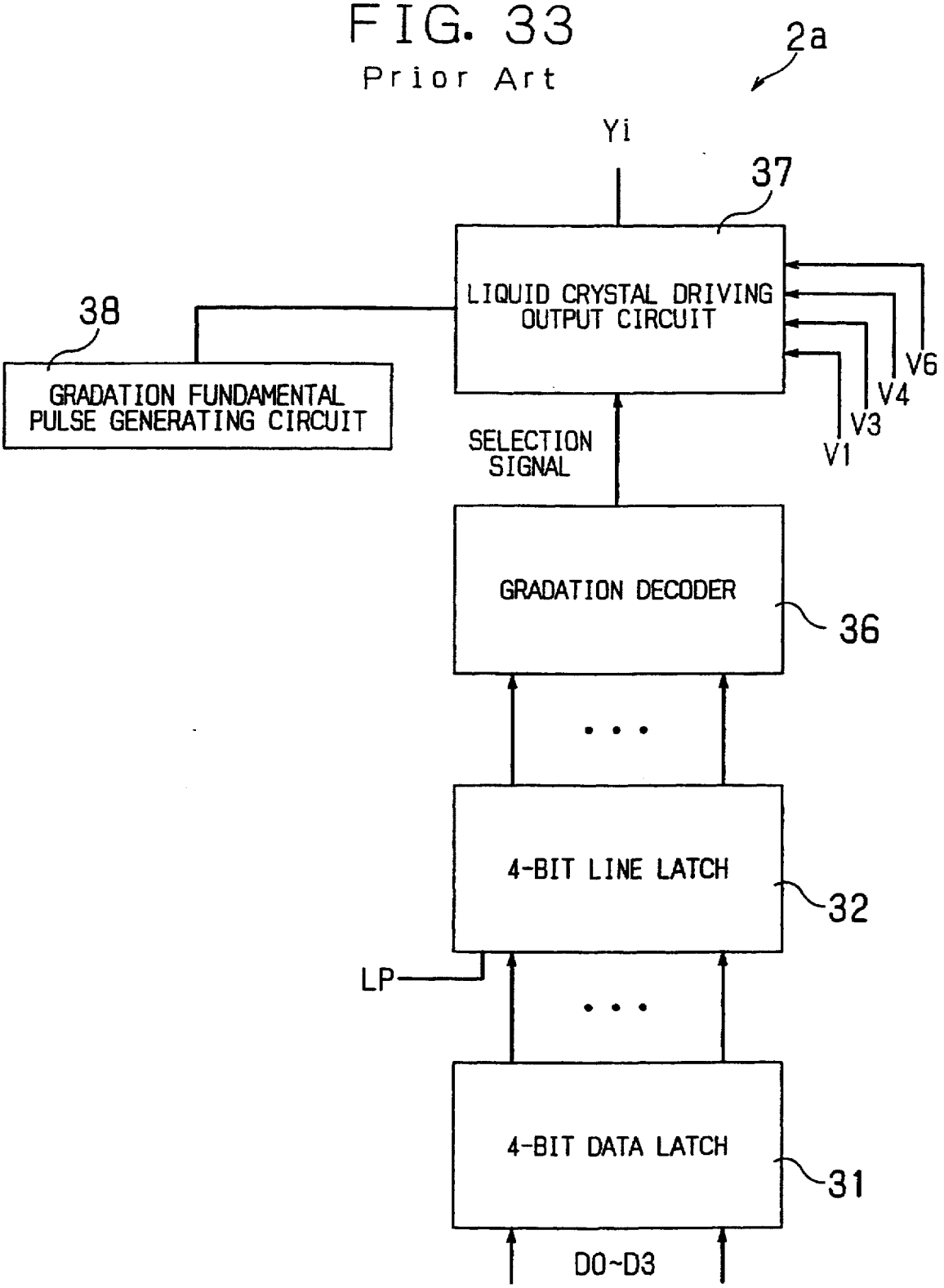
FIG. 33 Prior Art
FIG. 33 is a block diagram showing a electric structure of segment driver 2*a* for making gradation display by modulation by pulse number modulation method in a prior art.
Figures 34A, 34B:
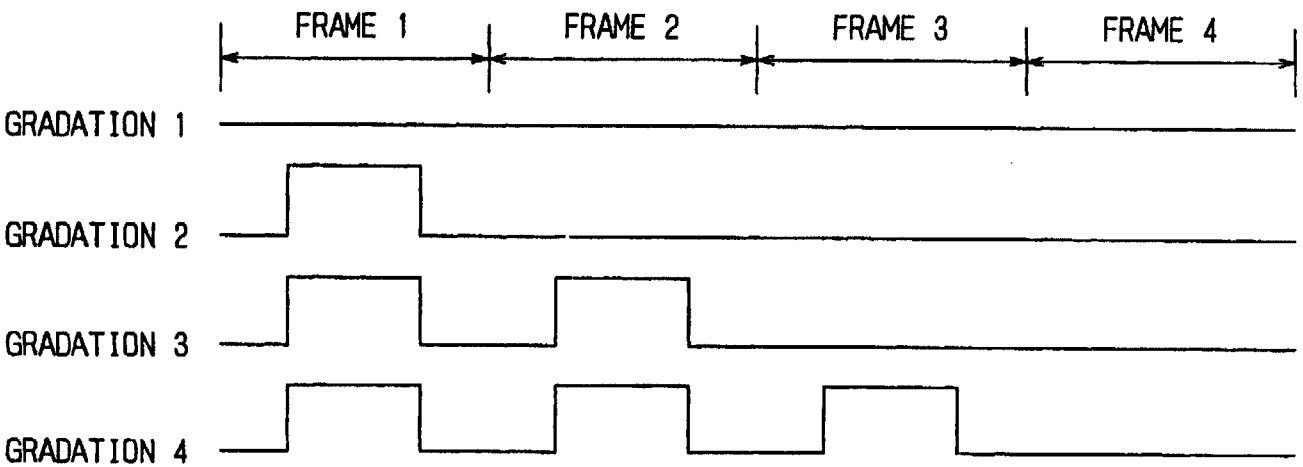
FIG. 34A Prior Art
FIG. 34B Prior Art
FIG. 34A is a diagram showing a changeover table used for gradation display by modulation by frame decimation method in a prior art.
FIG. 34B is a waveform diagram showing an output waveform when making gradation display by modulation by frame decimation method in a prior art.

FIG. 2A is a block diagram showing the structure of the segment driver 52, and FIG. 2B is a waveform diagram for explaining the operation of the segment driver 52. FIG. 2A and FIG. 2B relate to an example of 16-gradation display by four-bit data. In this embodiment, gradation display is made by pulse width modulation same as in the prior art shown in FIG. 29B. The four-bit input data D0 to D3 expressing gradations are read in a four-bit data latch 71, and after reading in the data of the portion of one row, it is read into a line latch 72 in batch in synchronism with a latch pulse LP. On the basis of the four-bit data read in the line latch 72, one of the input signals S0 to S15 having 16 types of pulse width is selected by a gradation decoder 73, and the pulse width of the segment output Yi from a liquid crystal driving output circuit 74 is variable. The segment output Yi is given to each column direction electrode of the liquid crystal display panel 51. The liquid crystal driving output circuit 74 of the embodiment outputs either one of the two different voltages VS1, VS2.

As shown in FIG. 2B, it is one frame period from fall of a latch pulse LP until next fall, and the input signals S0, S1, S2, S3, . . . ,Si, . . . , S15 are determined so as to be long in the high level period and broad in the pulse width in this order within one line period. When an input signal Si from the gradation decoder 73 is applied to the liquid crystal driving output circuit 74, the segment output Yi of the voltage VS1 is outputted only for the period equal to a period when the input signal Si is of high level. The alternate driving method of the liquid crystal display panel 51 is described later.

Figure 3:
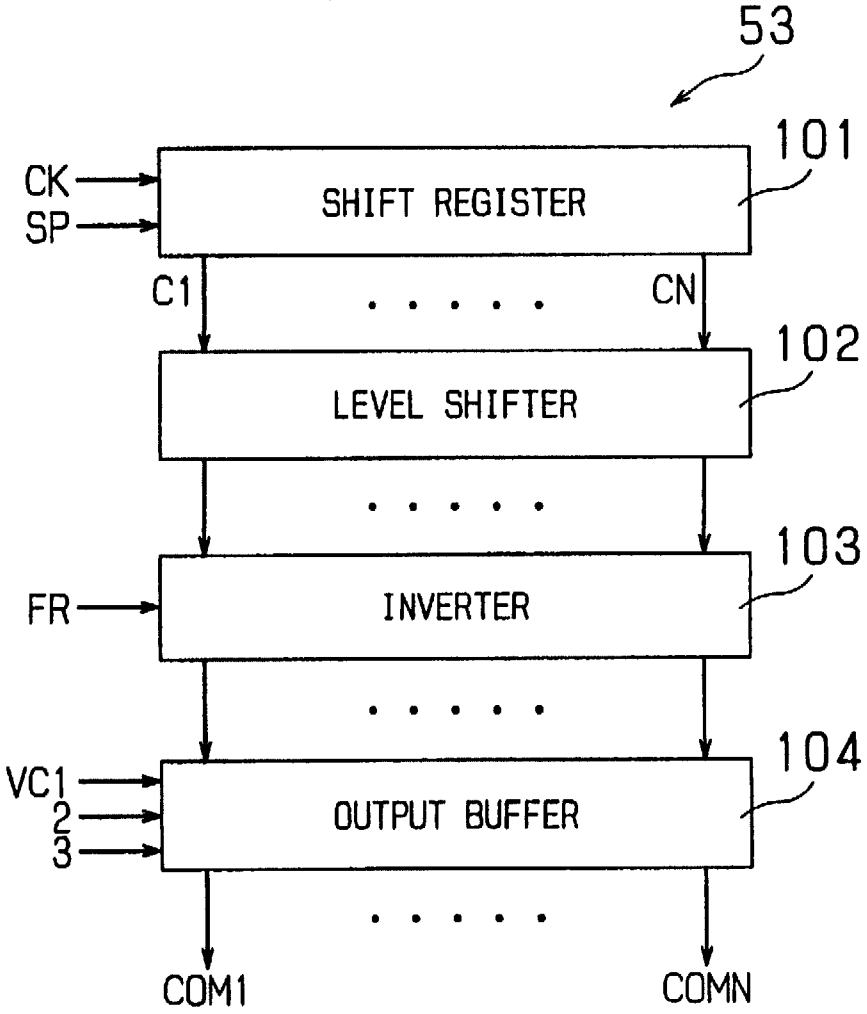
FIG. 3 is a block diagram showing a structure of a common driver 53.
Figure 4:
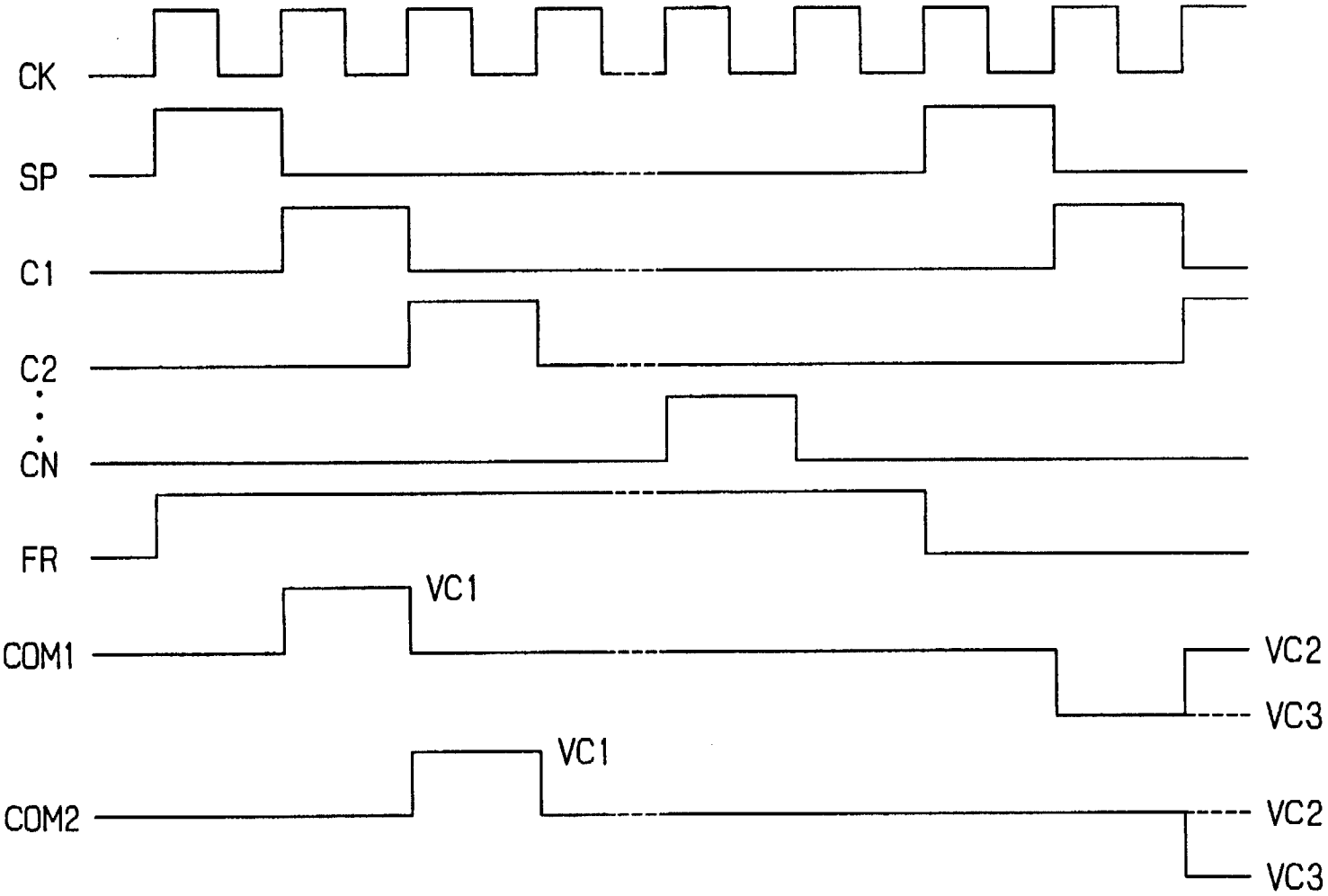
FIG. 4 is a diagram for explaining the operation of the common driver 53.

FIG. 3 is a block diagram showing a structure of the common driver 53, and FIG. 4 is a timing chart of the common driver 53. The common driver 53 is composed of a shift register 101, a level shifter 102, an inverter 103, and an output buffer 104. In the shift register 101, a horizontal synchronizing signal CK and a vertical synchronizing signal SP are fed. The shift register 101 applies signals C1, C2, . . . , CN sequentially to the level shifter 102 every time the horizontal synchronizing signal CK rises in a period from fall of vertical synchronizing signal SP until next fall. The level shifter 102 shifts the signals C1, C2, . . . , CN to specific voltage level, and applies to the inverter 103. The inverter 103 is provided with a control signal FR for specifying a period of driving the liquid crystal display panel 51 in alternating current.

The output buffer 104 is provided with the voltages VC1, VC2, VC3, and the common outputs COM1, COM2, . . . , COMN are delivered according to the signals C1 to CN and the control signal FR. The common outputs COM1, COM2, . . . , COMN are respectively applied to the row direction electrodes of the liquid crystal display panel 51. When the control signal FR is of high level, the common output COM1 is the voltage VC1 in the period when the signal C1 is of high level, and the common output COM1 is the voltage VC2 in the period when the signal C1 is of low level. When the control signal FR is of low level, the common output COM1 is the voltage VC3 in the period when the signal C1 is of high level, and the common output COM1 is the voltage VC2 in the period when the signal C1 is of low level. In this specification, the same reference numerals may be attached to the outputs from the drivers 52, 53 showing the voltage applied to the electrode, and the electrodes to which the outputs are applied.

Figure 5:
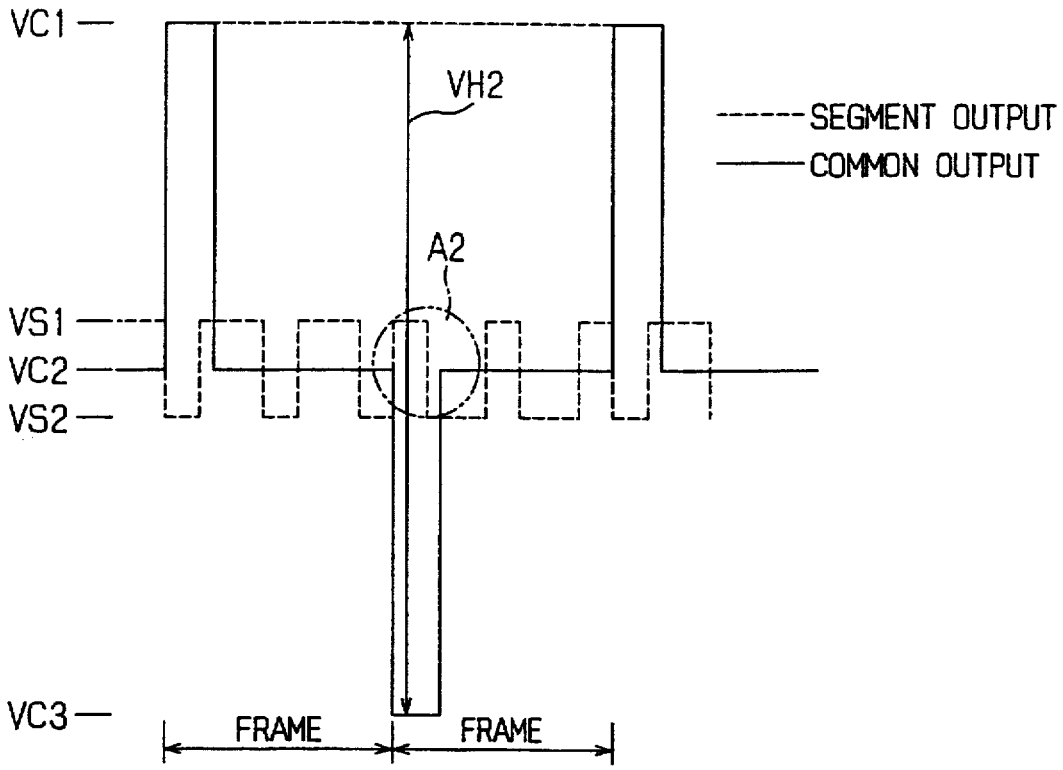
FIG. 5 is a waveform diagram showing a combined waveform of each output in the first embodiment.

FIG. 5 is a waveform diagram showing a combined waveform of the output waveform from the segment driver 52 and the output waveform from the common driver 53. In FIG. 5, the output waveform of the segment driver 52 is indicated by broken line and the output waveform of the common driver 53 is indicated by solid line.

From the common driver 53, as mentioned above, output waveforms changed by the three different voltages VC1, VC2, VC3 are obtained, and from the segment driver 52, output waveforms changed by the two different voltages VS1, VS2 are obtained. By the voltage difference of two output waveforms, it is determined whether the intersection of the row direction electrode and column direction electrode is in lighting state or in non-lighting state. The voltages VC1, VC2, VC3; VS1, VS2 are determined so as to light in the combination of the common output voltage VC1 and the segment output voltage V2, or common output voltage VC3 and segment output voltage VS1, and not to light in other combinations.

The driving voltage necessary when driving the liquid crystal display panel 51 is expressed in formula (8).

$$\text{Liquid crystal driving voltage} = \text{Vmax} = \{2(\sqrt{N+1}) - 2\} \times V_{TH} \quad (8)$$

Supposing the number of rows of the liquid crystal display panel 51 to be N=144, and the threshold voltage of liquid crystal to be $V_{TH}$ 2V, the driving voltage Vmax is 48 V. Supposing the voltage VC2 to be 0 V, for example, the voltages VC1, VS1, VS2, VC3 are respectively 26 V, 4 V, 2 V, −22 V. Therefore, in the common driver 53, a voltage of 48 V, which is the highest voltage VH2 from the voltages VC1 to VC3, is applied, whereas only 4 V from voltages VS1 to VS2 is applied to the segment driver 52. The common driver 53 must be manufactured in high withstand voltage process, but the segment driver 52 does not require high withstand voltage process.

Figure 6:
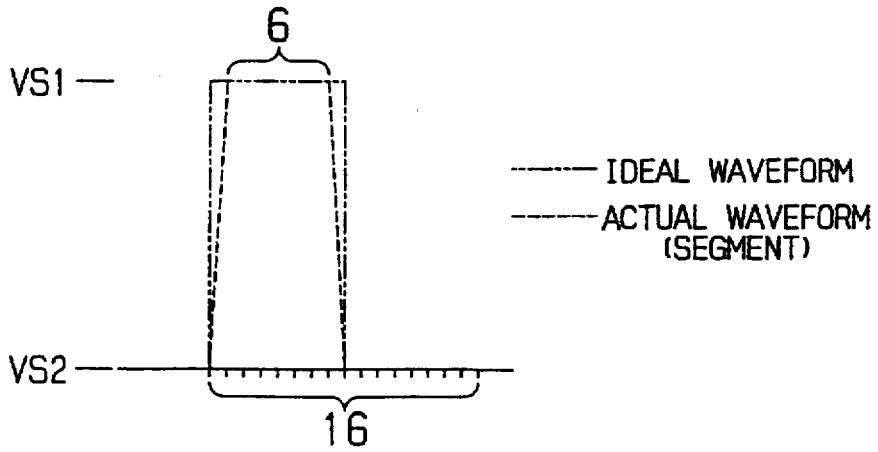
FIG. 6 is a partially magnified view of the output waveform in FIG. 5.

FIG. 6 is a magnified view of region A2 shown in FIG. 5. In FIG. 6, the waveform indicated by double dot chain line is an ideal voltage waveform to be applied to the column direction electrodes, and the waveform indicated by broken line is a voltage waveform actually applied to the column direction electrodes. As mentioned above, since the amplitude between two different voltages VS1 and VS2 of the segment output is small, waveform dullness is suppressed. Therefore, for example, as indicated by double dot chain line, the voltage waveform to displaying 5/16 gradations becomes a voltage waveform corresponding to 5/16 gradations as indicated by broken line, and it is possible to be closer to the ideal value than the waveform of the prior art.

Thus, according to the first embodiment of the invention, either one of the drivers 52, 53 in the liquid crystal driving device can be operated at low voltage regardless of the number of electrodes to be driven by that driver. Using the circuit operating at low voltage, the circuit does not require high withstand voltage process, and it can be manufactured in the same process together with other circuits disposed around the circuit.

Generally, in the liquid crystal driving device, the segment driver 52 for driving the column direction electrodes which are provided with a voltage on the basis of a signal for display, for example, a signal for gradation display, is provided by a greater number than the common driver 53, and if the structure of the liquid crystal display panel 51 becomes large and the number of column direction and row direction electrodes may increase, the area for forming the segment driver 52 is prevented from becoming larger.

Figure 7:
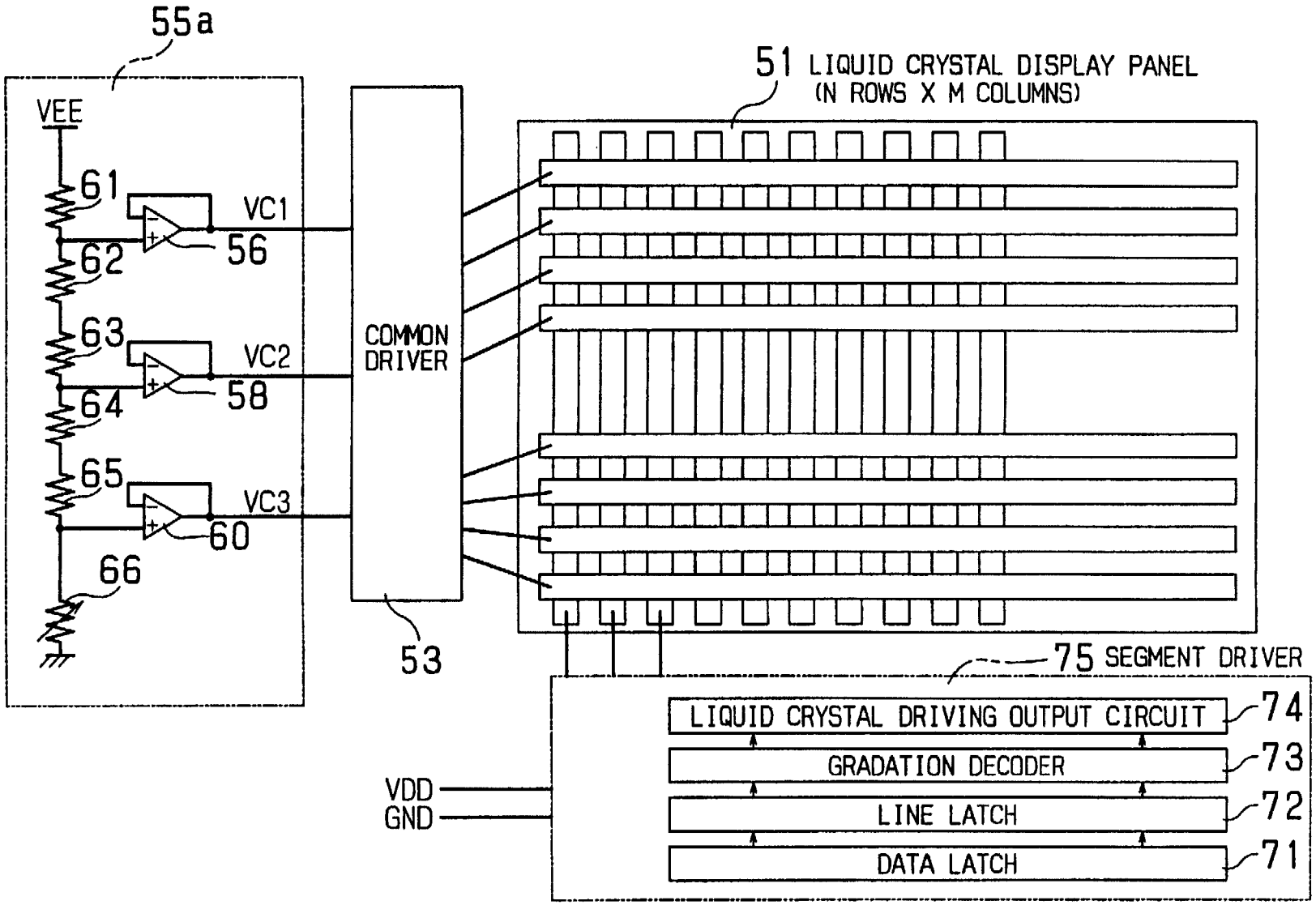
FIG. 7 is a block diagram showing an electric structure of a second embodiment of the invention.

FIG. 7 is a block diagram showing an electric structure of a liquid crystal display device including liquid crystal driving devices in a second embodiment of the invention. The components of the embodiment corresponding to those of the first embodiment are identified with same reference numerals. What is of note is that a segment driver 75 is provided with a supply voltage VDD of a standard logic semiconductor integrated circuit, for example, 5 V, which corresponds to VS1 in the embodiment in FIG. 1, and the grounding voltage GND is VS2, and the liquid crystal display panel 51 is driven. The standard logic semiconductor integrated circuit is, for example, TTL74 series or CMOS standard gate. These semiconductor integrated circuits operate when a voltage of 5 V±10% is given as the supply voltage VDD. A power source circuit 55*a* applies voltages C1, VC2, VC3 to the common driver 53. The segment driver 75 includes a data latch 71, a line latch 72, a gradation decoder 73, and a liquid crystal driving output circuit 74.

Figure 8A:
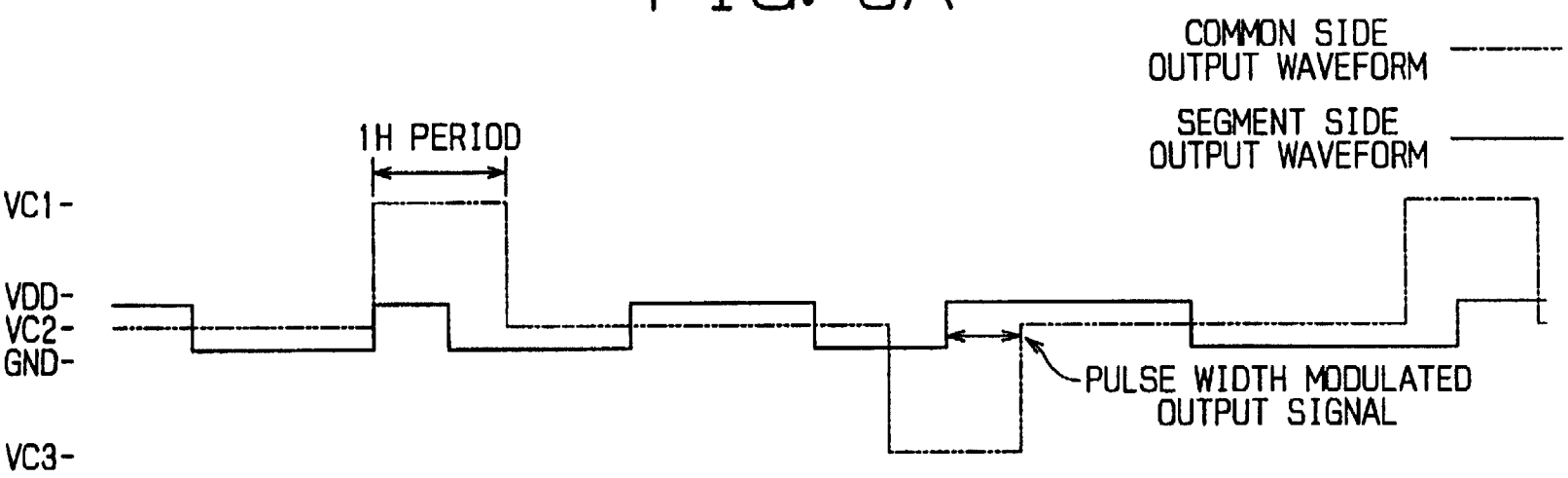
FIG. 8A is a waveform diagram showing a combined waveform of each output in the second embodiment.
Figure 8B:
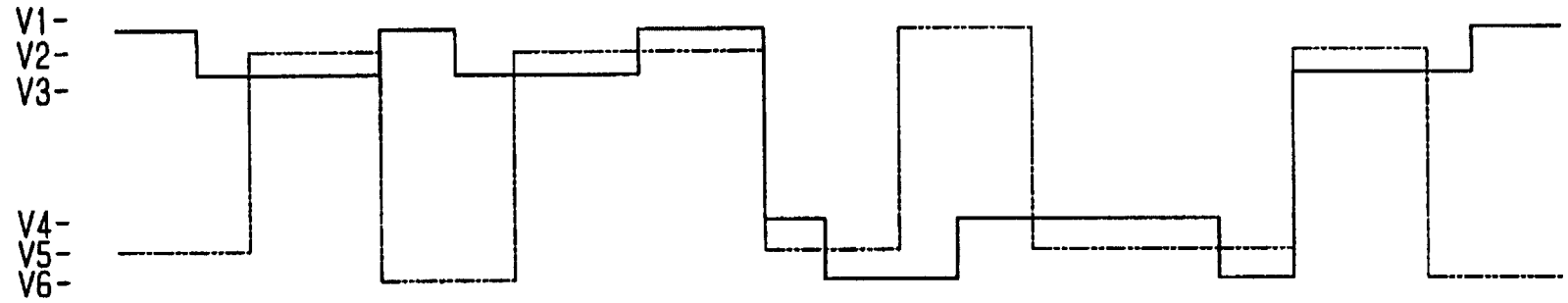
FIG. 8B Prior Art
FIG. 8B is a waveform diagram showing a combined waveform of each output in a prior art.

FIG. 8A is a waveform diagram showing a combined waveform of the output waveform from the common driver 53 and the output waveform from the segment driver 75 in the embodiment. The solid line refers to the output waveform from the segment driver 75, and the double dot chain line indicates the output waveform from the common driver 53. In this embodiment, same as in the first embodiment, by pulse width modulation, the segment side output waveform varies, and the gradation display is made. FIG. 8B is a waveform diagram by combining the output waveforms in the prior art.

In the combined waveform of the prior art shown in FIG. 8B, it is the lighting state when the voltage indicated by the common side output waveform and the voltage indicated by the segment side output waveform are either one of the voltages V1, V6.

In the combined waveform of the embodiment in FIG. 8A, it is the lighting state when the voltage indicated by the common side output waveform is the voltage VC1 and the voltage specified by the segment side output waveform is voltage GND, or when the voltage indicated by the common side output waveform is voltage VC3 and the voltage indicated by the segment side output waveform is voltage VDD.

Thus, according to the second embodiment of the invention, while having the same effects as the in the first embodiment, the operating voltage of, for example, the segment driver 75 is same as in the standard logic semiconductor integrated circuit, and manufacture of the segment driver 75 does not require high withstand voltage manufacturing process, and the area for forming the segment driver 75 may be reduced. Besides, the segment driver 75 and the semiconductor integrated circuit can be formed simultaneously in the same process, and thereby downsizing, namely use of LSI can be realized. By realizing the use of LSI, the structure for driving the liquid crystal display panel 51 may be reduced.

Figure 9:
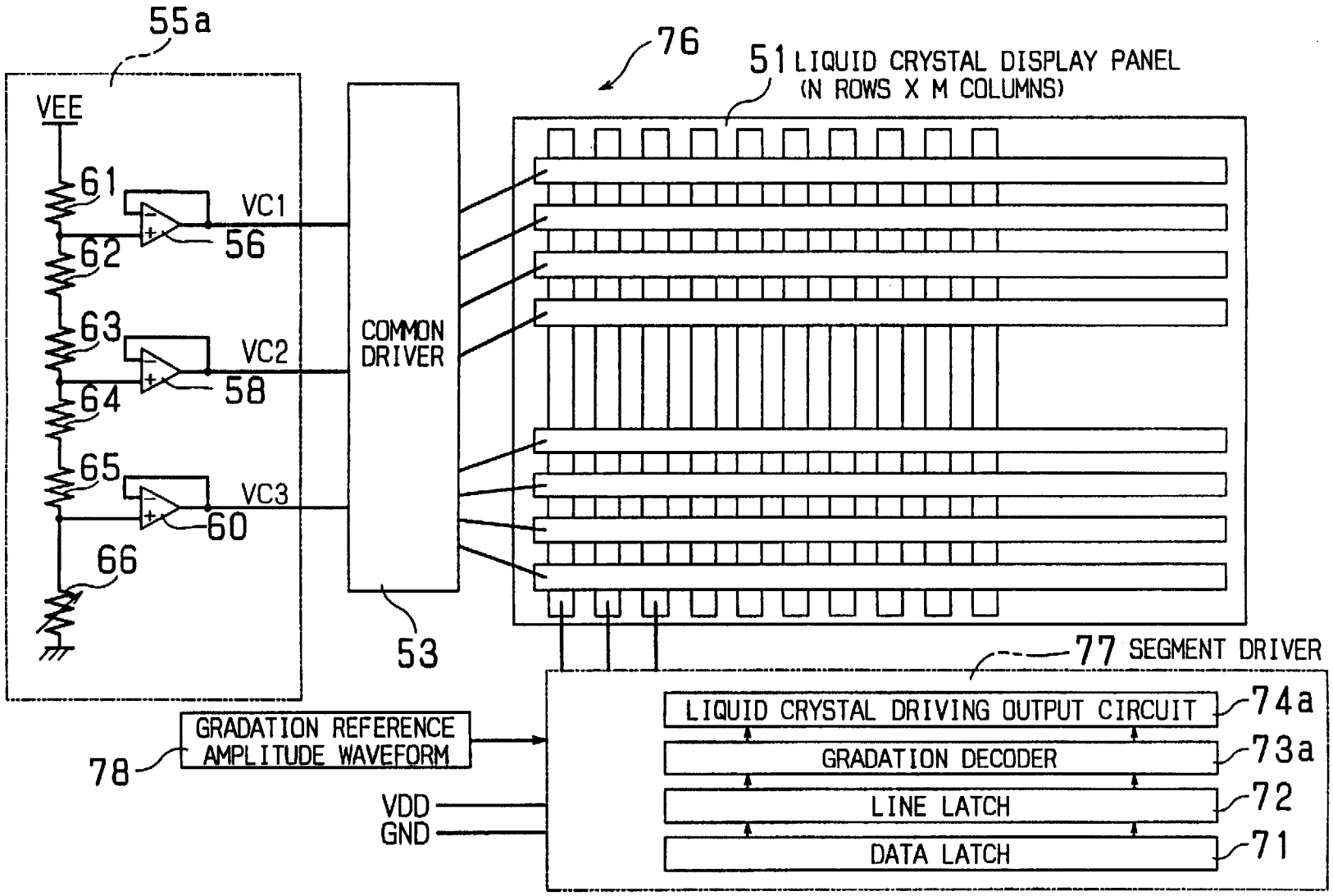
FIG. 9 is a block diagram showing an electric structure of a third embodiment of the invention.

FIG. 9 is a block diagram showing an electric structure of a liquid crystal display device 76 including liquid crystal driving devices in a third embodiment of the invention. This embodiment is similar to the second embodiment, and corresponding parts are identified with same reference numerals and explanations are omitted. It is a feature of the embodiment that amplitude modulation is employed as a modulating method for realizing gradation display. A segment driver 77 outputs an output waveform by amplitude modulation on the basis of the gradation display data D0 to D3. The amplitude waveform as the basis for amplitude modulation is given from a gradation reference amplitude waveform generating circuit 78.

Figure 10:
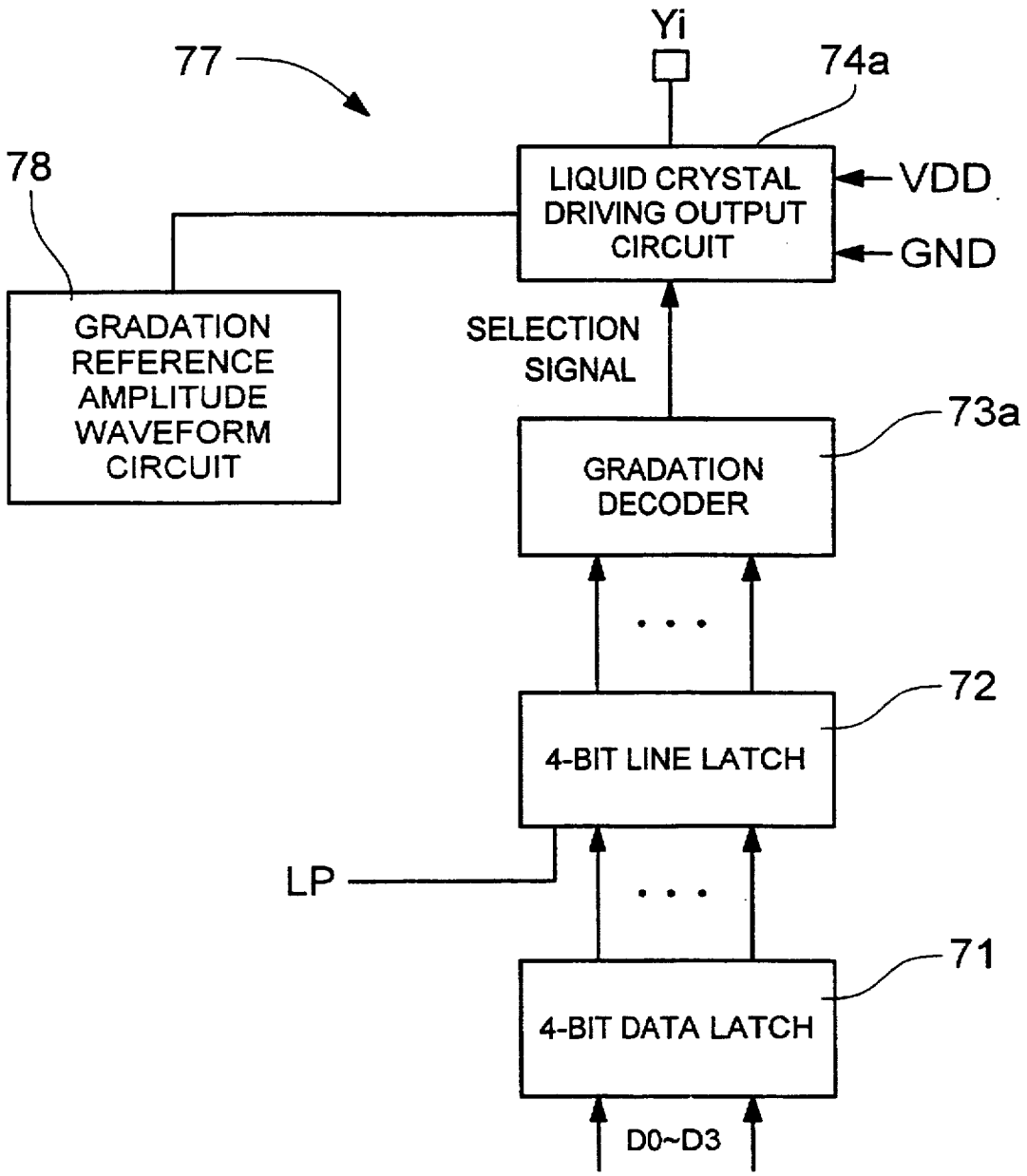
FIG. 10 is a block diagram showing a structure of segment driver 77.

FIG. 10 is a block diagram showing a structure of the segment driver 77. In the segment driver 77, the same constituent elements as in the segment driver 52 are identified with same reference numerals and explanations are omitted. In the following description, too, the signal for gradation display is supposed to be four-bit data.

On the basis of four-bit data read in the line latch 72, a gradation decoder 73*a* gives a selection signal to deliver which amplitude voltage to a liquid crystal driving output circuit 74*a*. The liquid crystal driving output circuit 74*a* outputs one of the 16 types of amplitude voltages supplied from the gradation reference amplitude waveform generating circuit 78 on the basis of the selection signal, as segment output Yi from the liquid crystal driving output circuit 74*a*.

The liquid crystal driving output circuit 74a of the embodiment outputs either one of the two different voltages VDD and GND.

Figure 11:
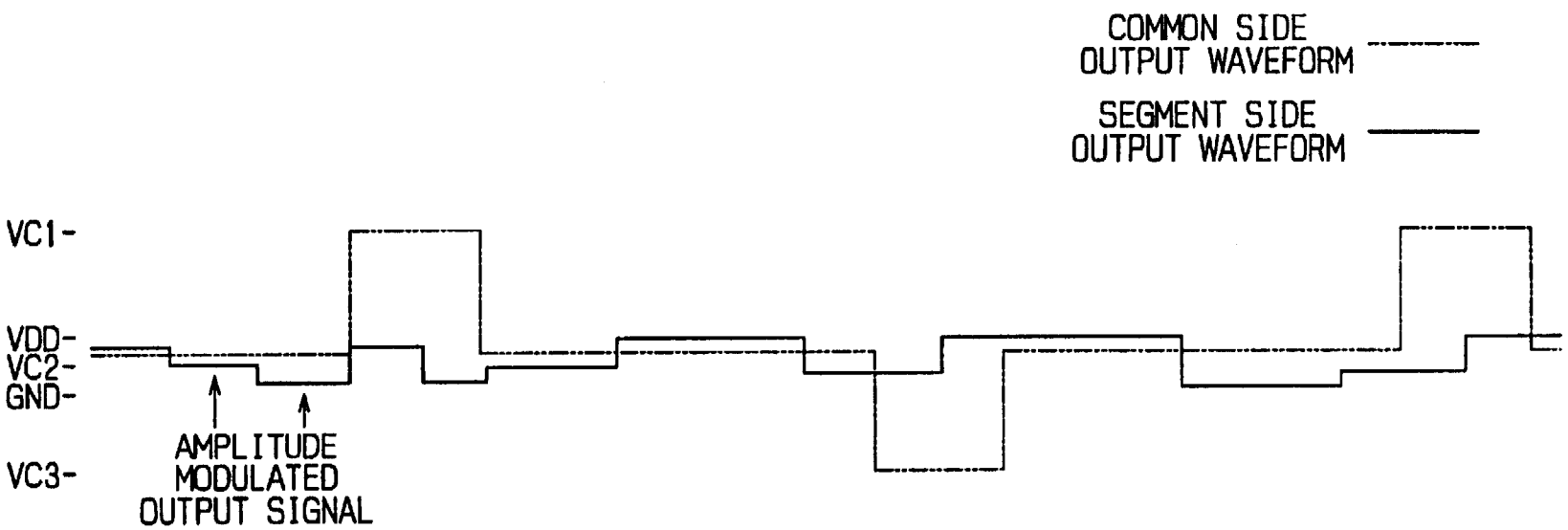
FIG. 11 is a waveform diagram showing a combined waveform of each output in the third embodiment.

FIG. 11 is a waveform diagram showing a combined waveform of the output waveform from the common driver 53 and the output waveform form the segment driver 77 in the embodiment. In FIG. 11, the solid line refers to the output waveform from the segment driver 77, and the double dot chain line denotes the output waveform from the common driver 53.

As shown in FIG. 11, when the amplitude of the segment output waveform from the liquid crystal driving output circuit 74a is changed between voltage VDD and GND as amplitude modulation, the difference in voltage from the common side output voltage varies, and this difference in voltage realizes gradation display.

Thus, according to the third embodiment of the invention, since the absolute amount of change of the level of output voltage from the segment driver 77 decreases, the waveform dullness becomes smaller, and as a result of amplitude modulation, therefore, the waveform of the voltage applied to the liquid crystal display panel 51 is closer to the ideal waveform, and uneven luminance can be decreased. At the same time, the current consumption of the entire liquid crystal display device 76 is saved, and a high integration is realized in the case of composition of the segment driver 77 by semiconductor integrated circuit.

Figure 12:
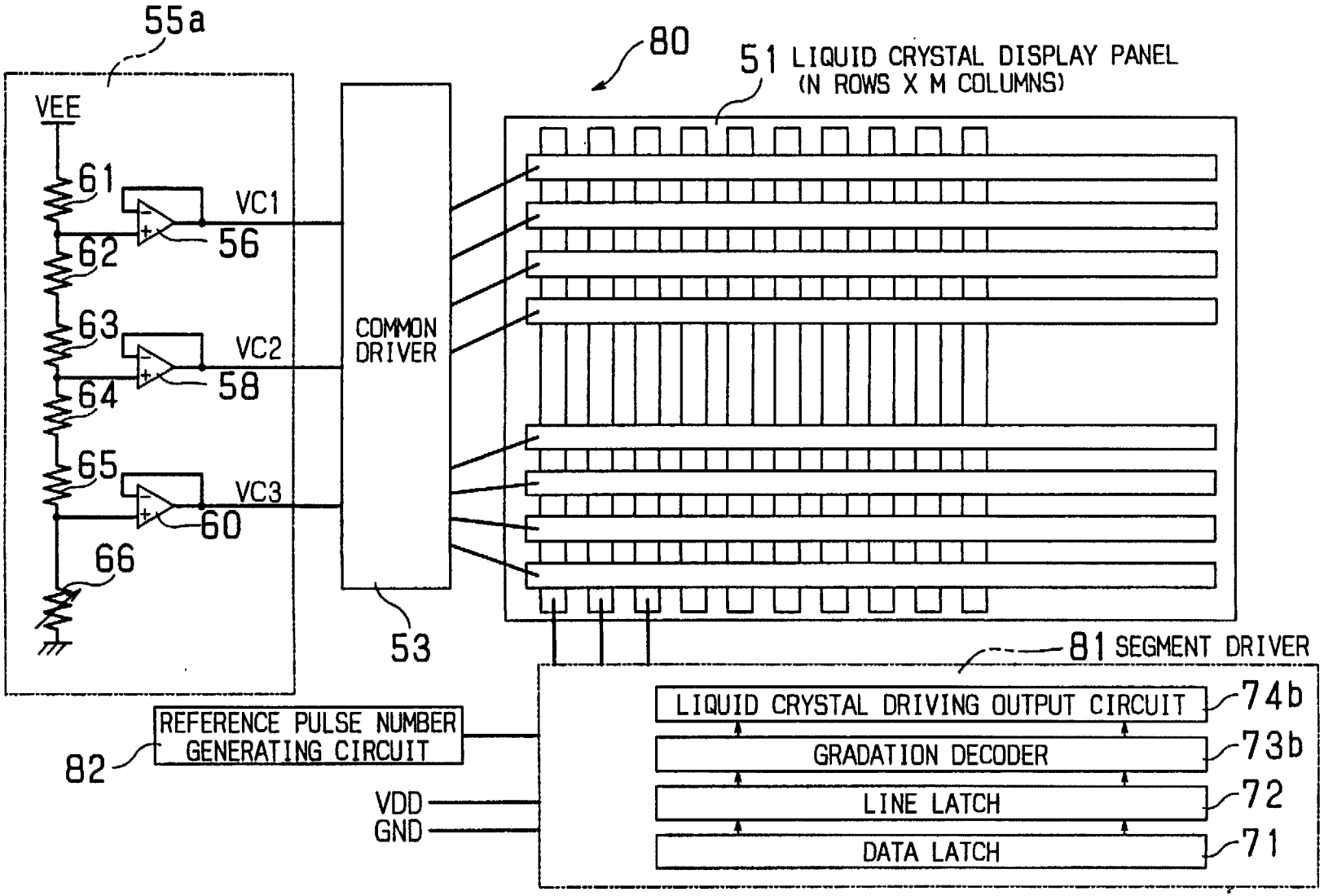
FIG. 12 is a block diagram showing an electric structure of a fourth embodiment of the invention.

FIG. 12 is a block diagram showing an electric structure of a liquid crystal display device 80 including liquid crystal driving devices in a fourth embodiment of the invention. This embodiment is also similar to the second embodiment, and corresponding parts are identified with same reference numerals and explanations are omitted. It is a feature of the embodiment that pulse number modulation is employed as a modulating method for realizing gradation display.

Figure 13:
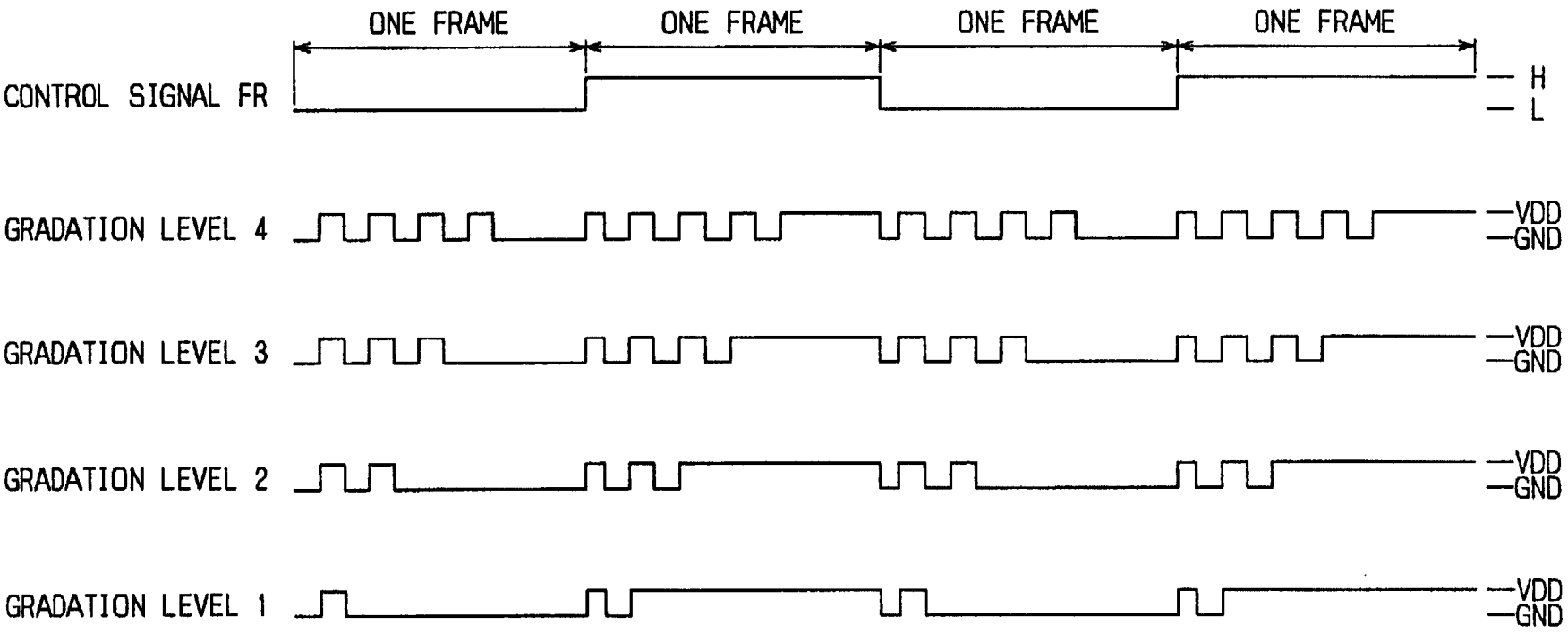
FIG. 13 is a waveform diagram showing an operation waveform in the fourth embodiment.

A reference pulse number generating circuit 82 generates a pulse signal depending on the number of gradations to be displayed in a liquid crystal display panel 51 in one frame period, and applies to a liquid crystal driving output circuit 74b in a segment driver 81 as shown in FIG. 13. On the basis of the output of a line latch 72, a gradation decoder 73b determines how many pulse signals are to be outputted in one frame period, and applies a signal showing the number of pulse signals to the liquid crystal driving output circuit 74b as selection signal. The liquid crystal driving output circuit 74b outputs a pulse signal corresponding to the number of gradations indicated by the gradation display signal in one frame period on the basis of the selection signal.

In FIG. 13, showing a control signal FR, a case of AC driving in one frame period is given. When the control signal FR is of high level, the selective level for lighting state is voltage GND, and non-selective level for non-lighting sate is voltage VDD. When the control signal FR is of low level, the selective level for lighting state is voltage VDD, and non-selective level for non-lighting state is voltage GND.

Thus, according to the fourth embodiment of the invention, since the segment output level is either voltage VDD or GND, the absolute amount of change of voltage decreases, and waveform dullness also decreases, and as a result, therefore, when pulse number modulation is conducted, the waveform of the voltage applied to the liquid crystal display panel 51 may be closer to the ideal voltage waveform, and uneven luminance may be decreased. At the same time, the current consumption of the system of the entire liquid crystal display device is saved, and a high integration is realized in the case of composition of the segment driver 81 by semiconductor integrated circuit.

Figure 14:
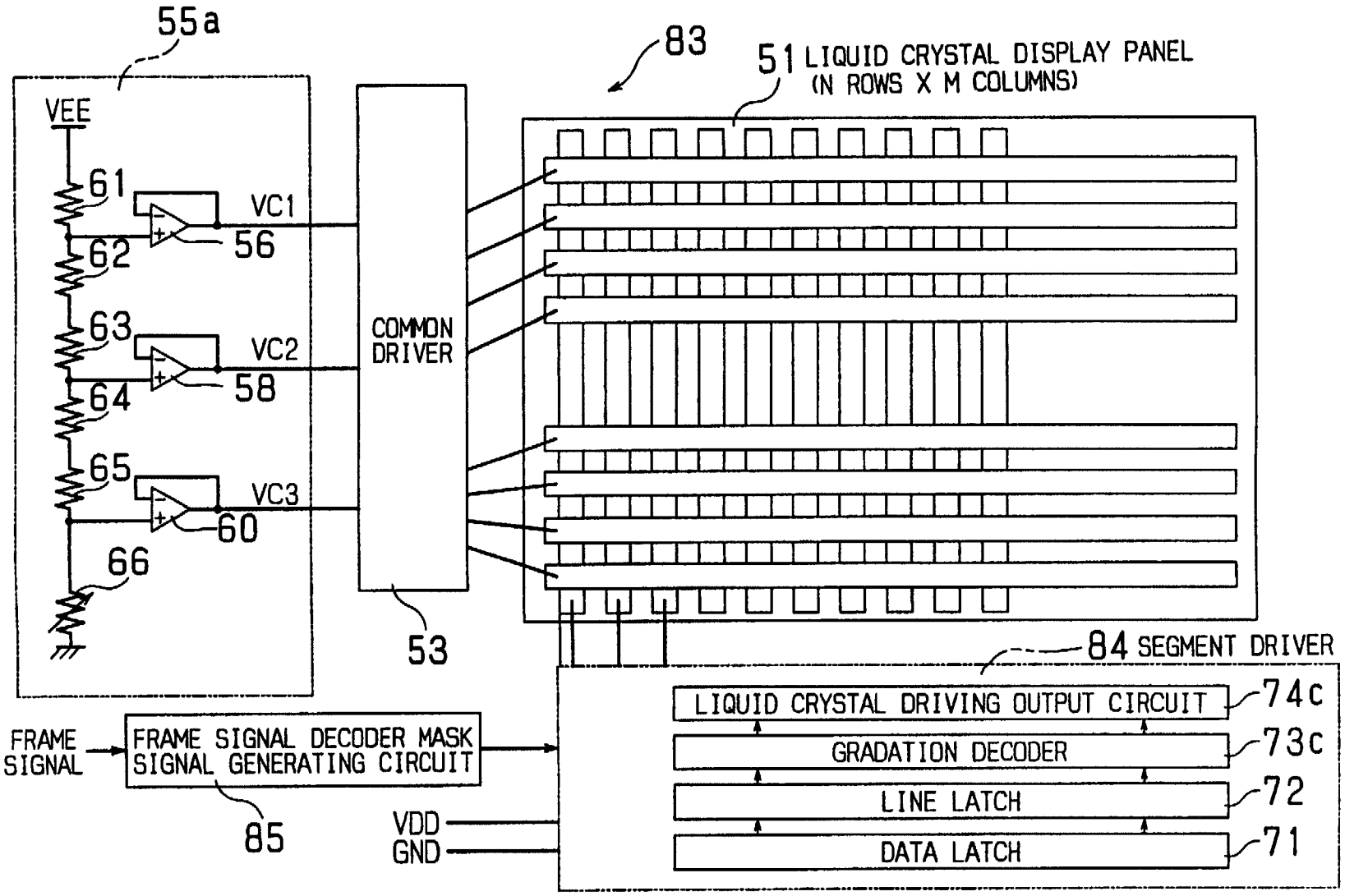
FIG. 14 is a block diagram showing an electric structure of a fifth embodiment of the invention.

FIG. 14 is a block diagram showing an electric structure of a liquid crystal display device 83 including liquid crystal driving devices in a fifth embodiment of the invention. This embodiment is also similar to the second embodiment, and corresponding parts are identified with same reference numerals and explanations are omitted. It is a feature of the embodiment that frame changeover modulation or so-called frame decimation method is employed as a modulating method for realizing gradation display.

Figure 15:
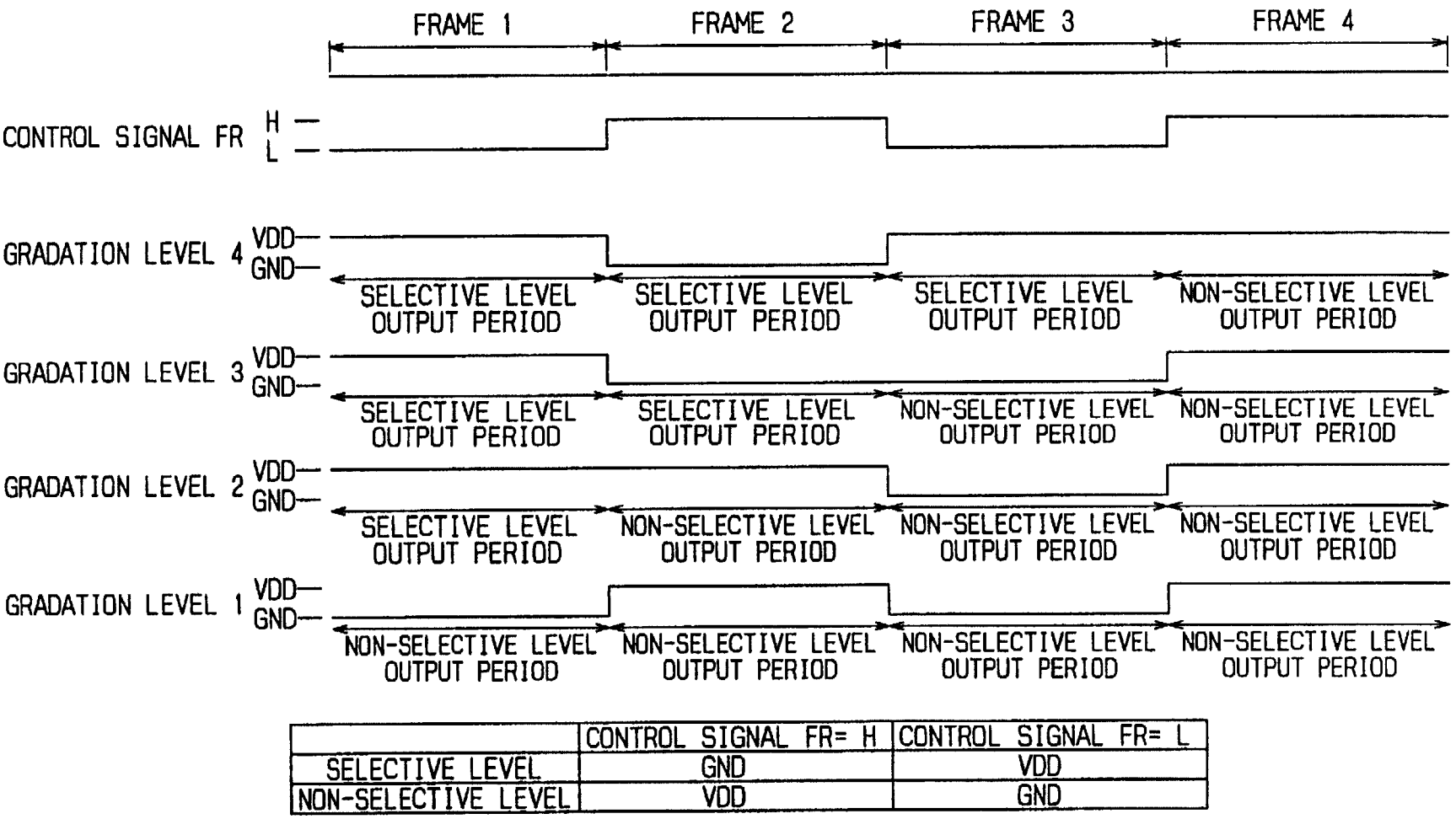
FIG. 15 is a waveform diagram showing an operation waveform in the fifth embodiment.

In a frame signal decoder mask signal generating circuit 85, a frame signal for determining one frame period is given from other circuit (not shown). The frame signal decoder mask signal generating circuit 85 generates a mask signal for decimating the frames on the basis of the frame signal, and gives it to a liquid crystal driving output circuit 74c. The frame signal is a signal showing one frame period which is the unit of image to be displayed by the liquid crystal display panel 51. Using the mask signal, as shown in FIG. 15, four frame periods are reduced to one reference period, and gradation display of four steps is realized by frame changeover modulation.

On the basis of the output of the line latch 72, the gradation decoder 73c gives the signal showing which frame period should be used as selective level to the liquid crystal driving output circuit 74c, in the frame period determined as reference. The liquid crystal driving output circuit 74c outputs either selective voltage or non-selective voltage in every frame period, in the reference frame period on the basis of the selection signal. In FIG. 15, meanwhile, showing the control signal FR, the case of AC driving in every one frame period is illustrated. When the control signal FR is of high level, the selective level for lighting state is voltage GND, and non-selective level for non-lighting sate is voltage VDD. When the control signal FR is of low level, the selective level for lighting state is voltage VDD, and non-selective level for non-lighting state is voltage GND.

Thus, according to the fifth embodiment of the invention, since the segment output level is either voltage VDD or GND, the absolute amount of change of voltage decreases, and waveform dullness also decreases, and as a result, therefore, the waveform of the voltage applied to the liquid crystal display panel 51 in the case of pulse number modulation may be closer to the ideal voltage waveform, and uneven luminance may be decreased, and moreover the current consumption of the entire system is saved, and a high integration is realized in the case of composition of the segment driver by semiconductor integrated circuit.

Figure 16:
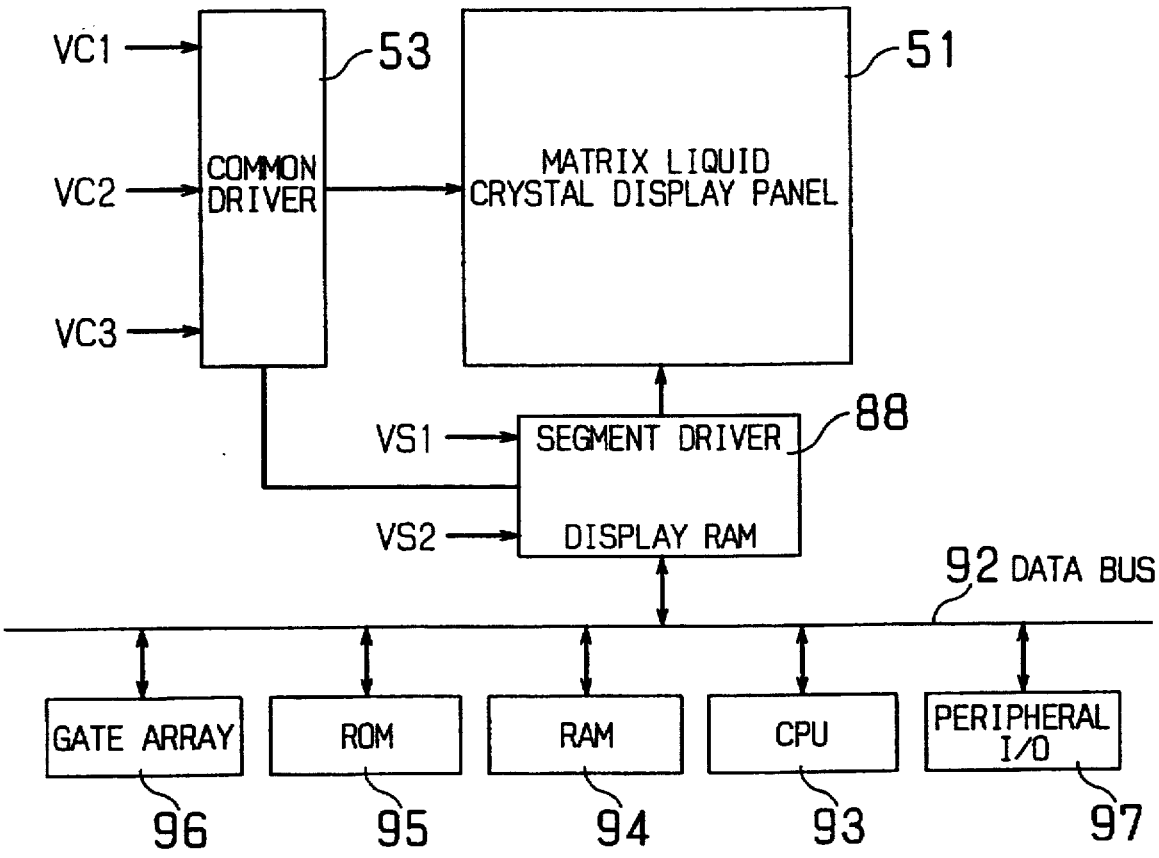
FIG. 16 is a block diagram showing an electric structure of a sixth embodiment of the invention.
Figure 17:
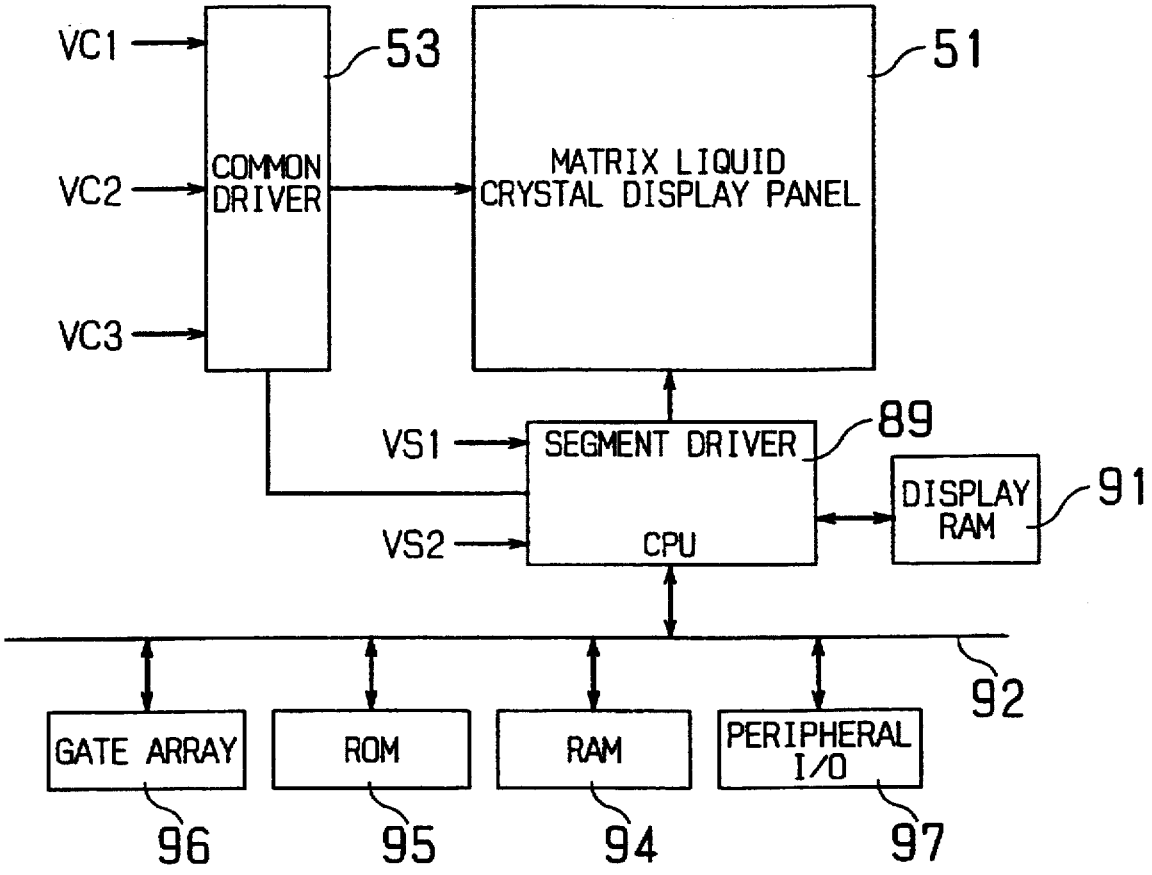
FIG. 17 is a block diagram showing an electric structure of a seventh embodiment of the invention.
Figure 18:
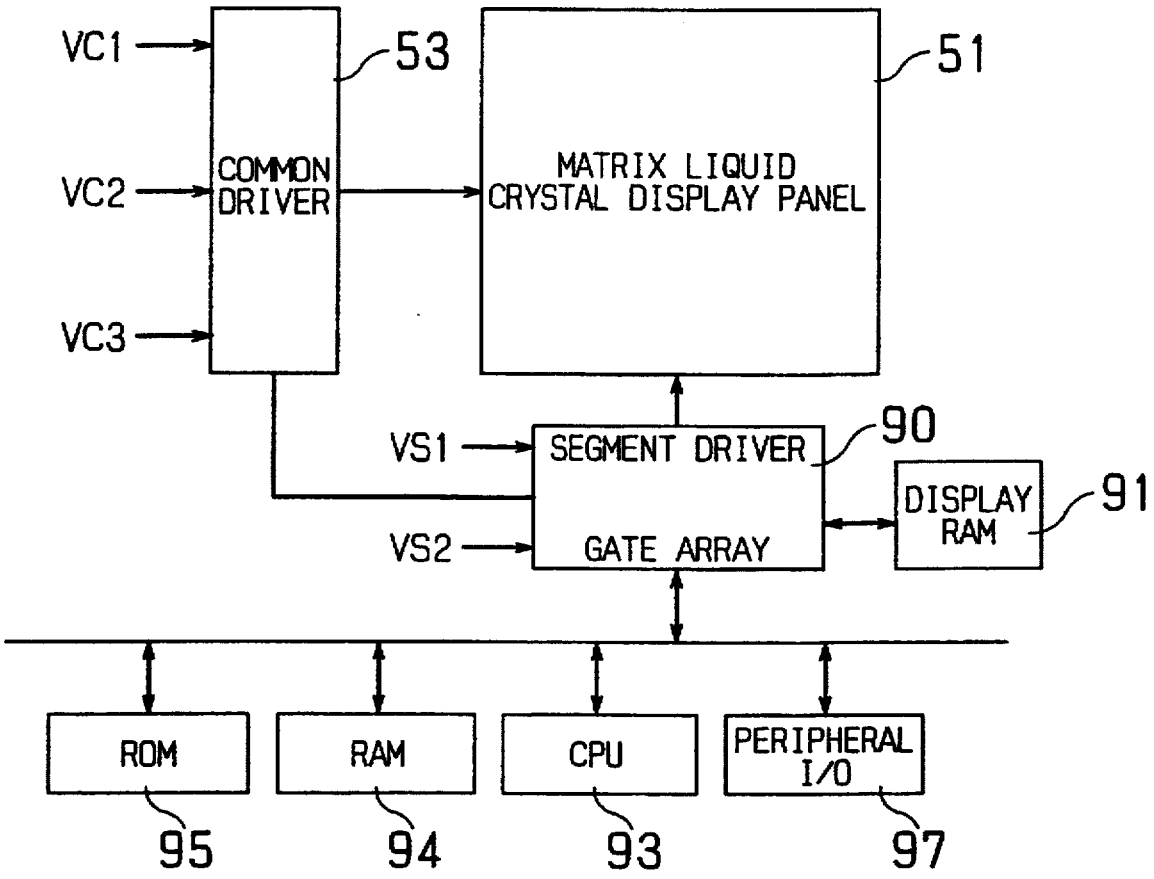
FIG. 18 is a block diagram showing an electric structure of an eighth embodiment of the invention.
Figure 19:
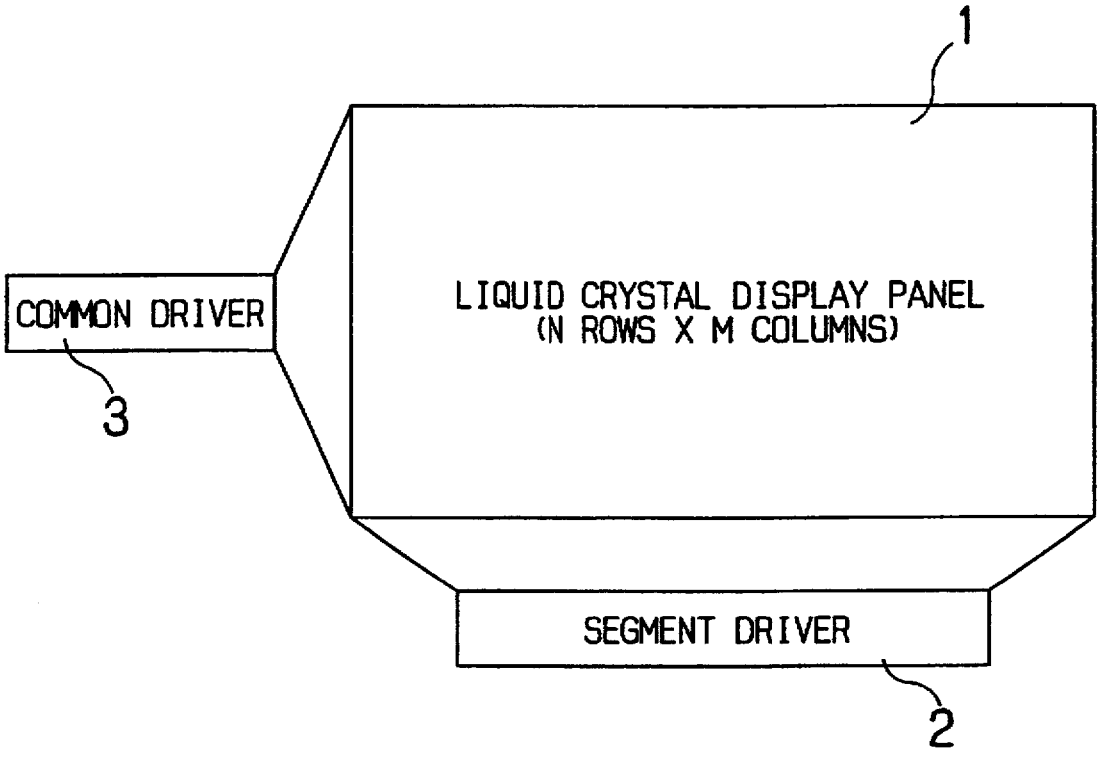
FIG. 19 Prior Art
FIG. 19 is a simplified block diagram showing an electric structure for driving a simple matrix type liquid crystal display panel 1 of a prior art.
Figure 20A:
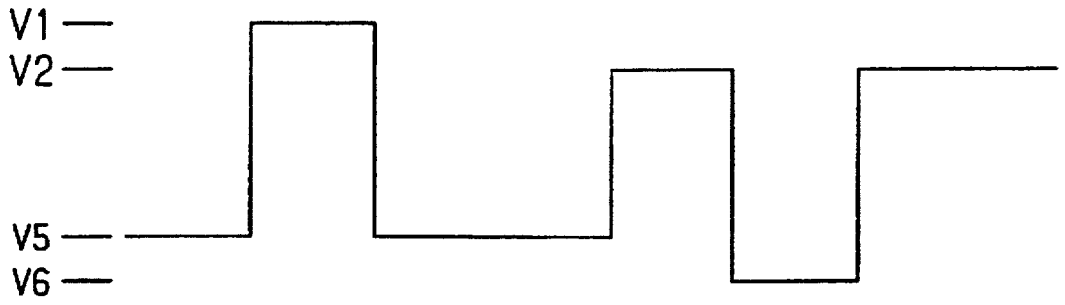
FIG. 20A Prior Art
FIG. 20A is a waveform diagram showing an output waveform of common driver 3.
Figure 20B:
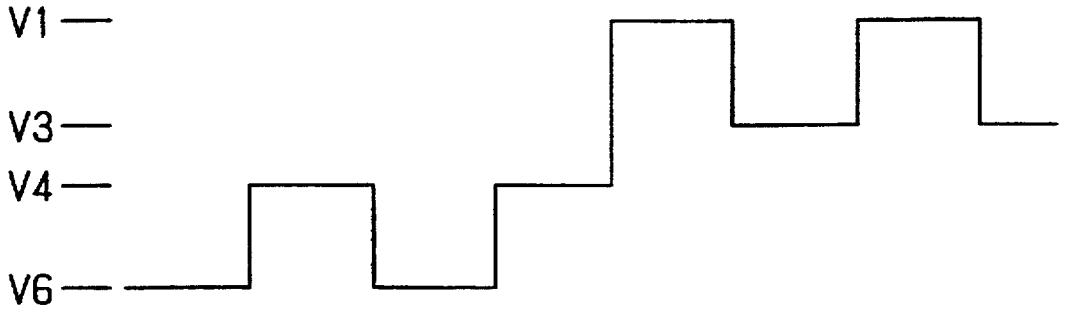
FIG. 20B Prior Art
FIG. 20B is a waveform diagram showing an output waveform of segment driver 2.
Figure 21:
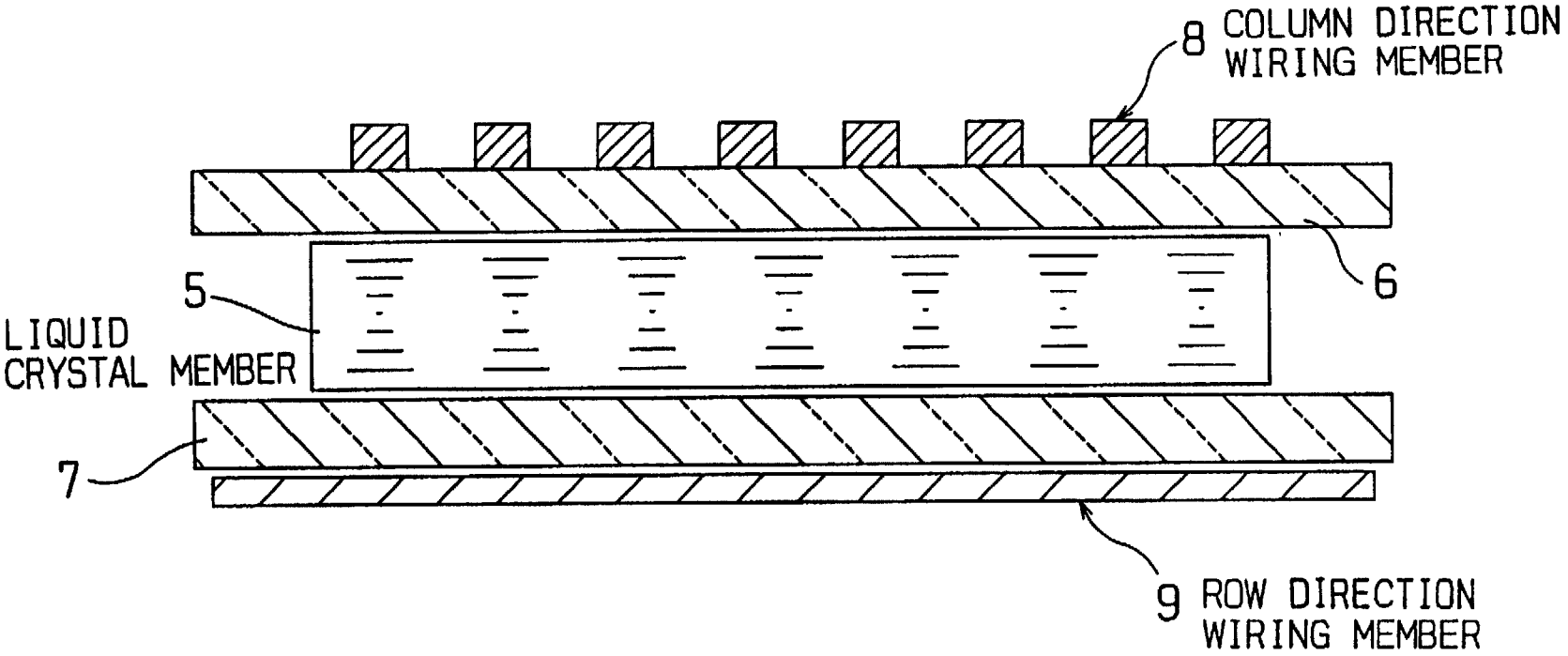
FIG. 21 Prior Art
FIG. 21 is a side sectional view showing a basic structure of liquid crystal display panel 1.
Figure 22:
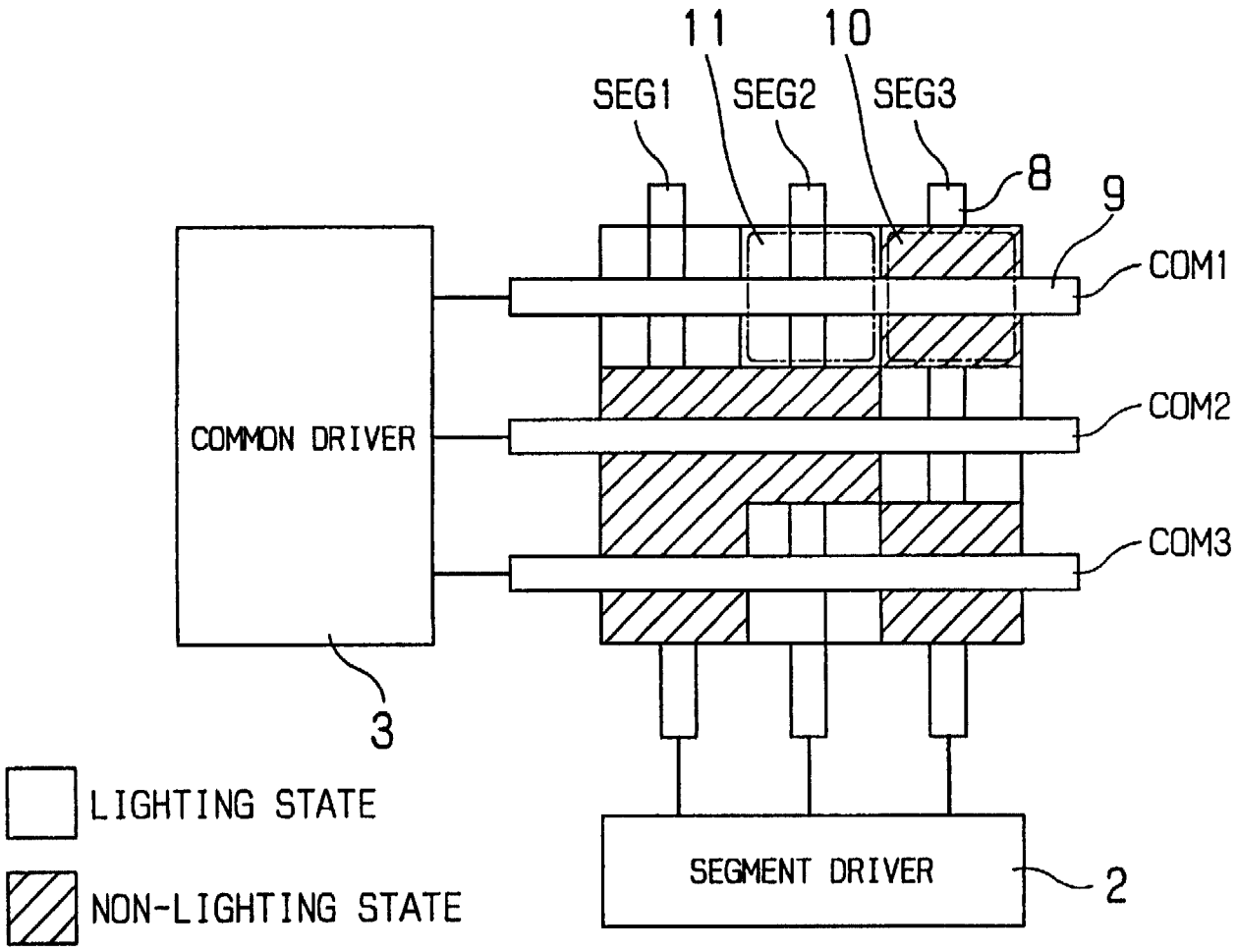
FIG. 22 Prior Art
FIG. 22 is a plan view for explaining the operating state of the liquid crystal display panel 1.
Figure 23:
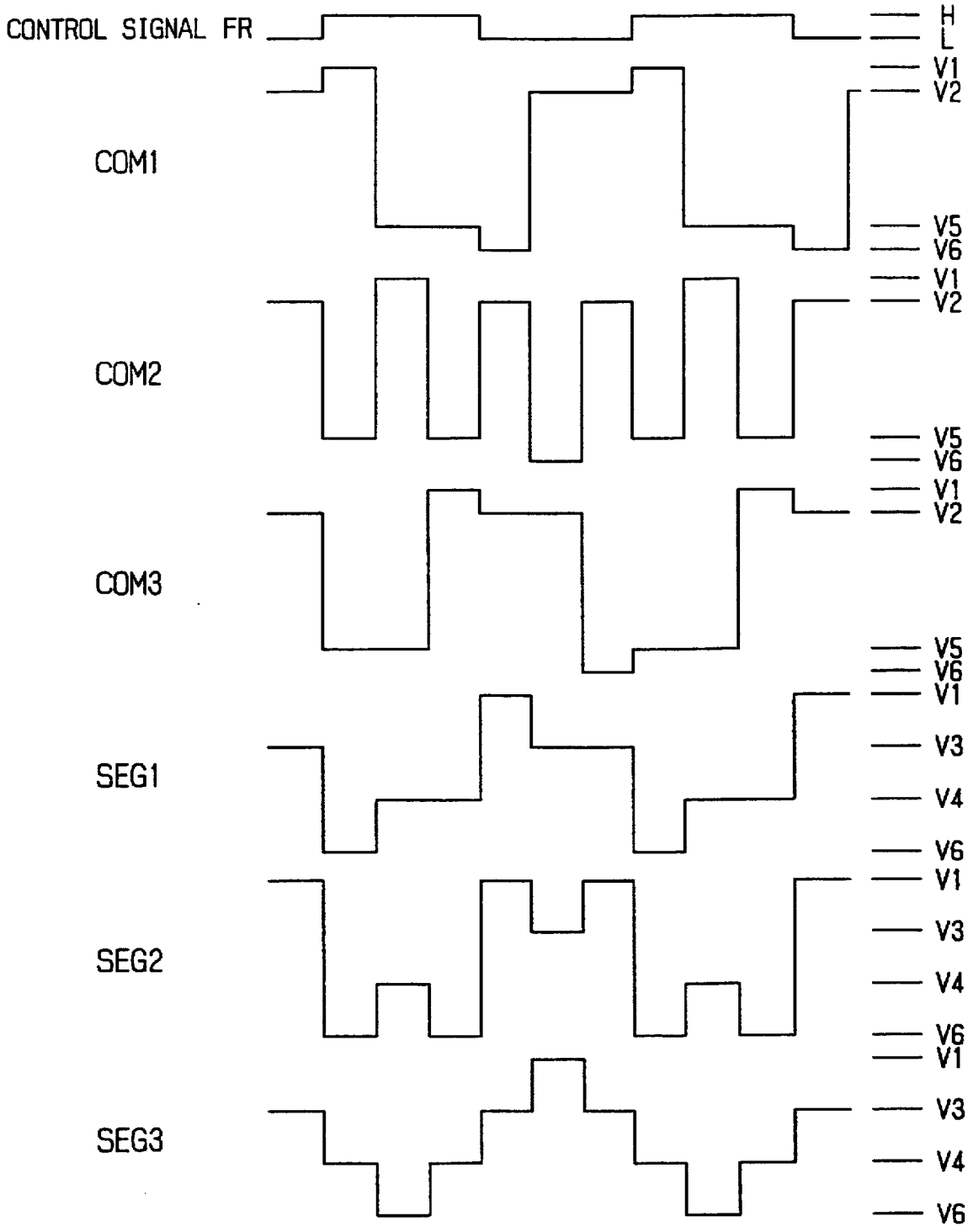
FIG. 23 Prior Art
FIG. 23 is a waveform diagram showing an output waveform for driving each electrode of liquid crystal display panel 1.
Figure 24A:
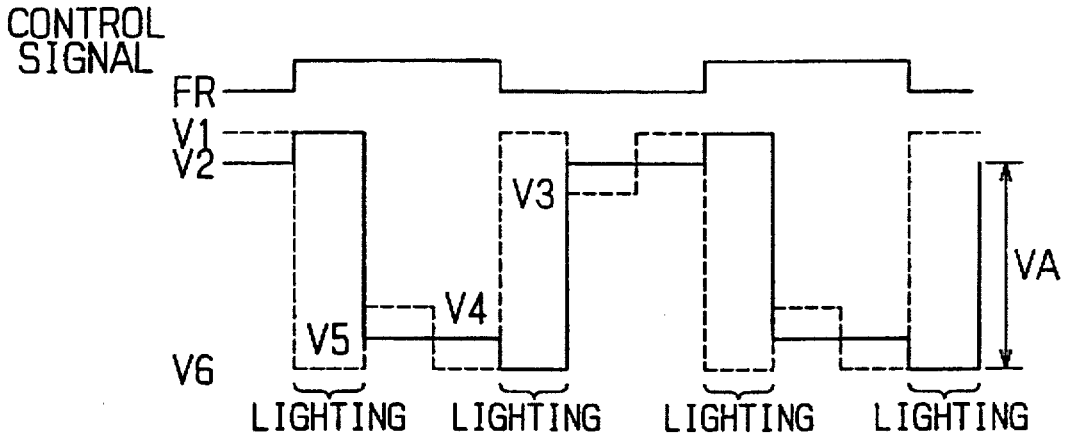
FIG. 24A Prior Art
FIG. 24A is a waveform diagram showing a combined waveform of each output in lighting state.
Figure 24B:
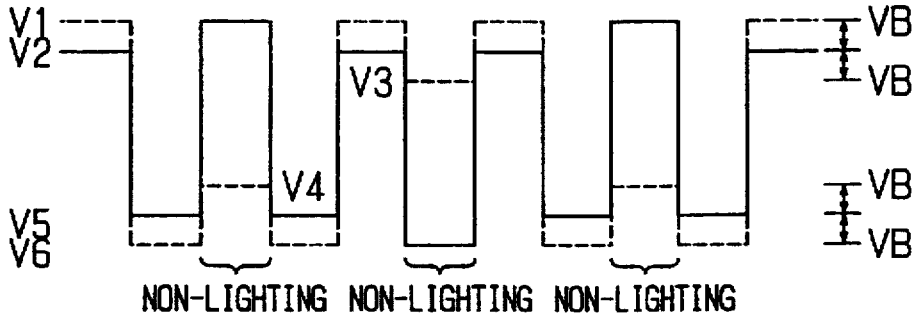
FIG. 24B Prior Art
FIG. 24B is a waveform diagram showing a combined waveform of each output in non-lighting state.
Figure 25:
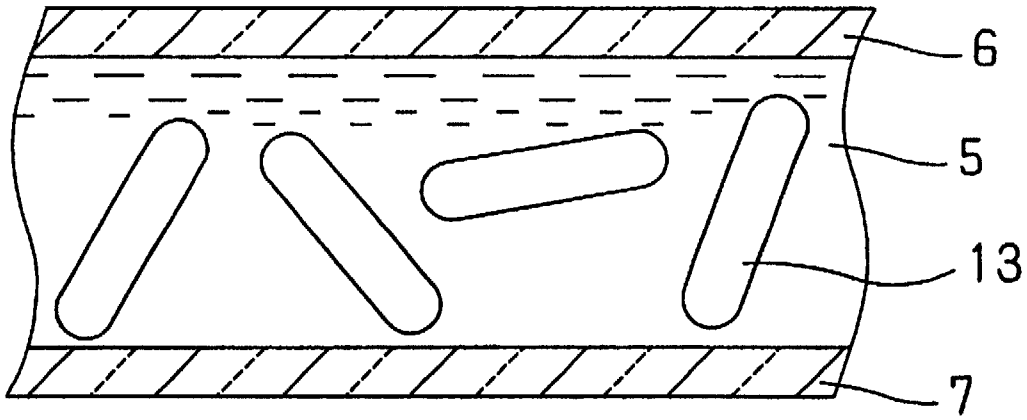
FIG. 25 Prior Art
FIG. 25 is a schematic diagram for explaining the necessity of AC driving of liquid crystal display panel 1.
Figure 26:
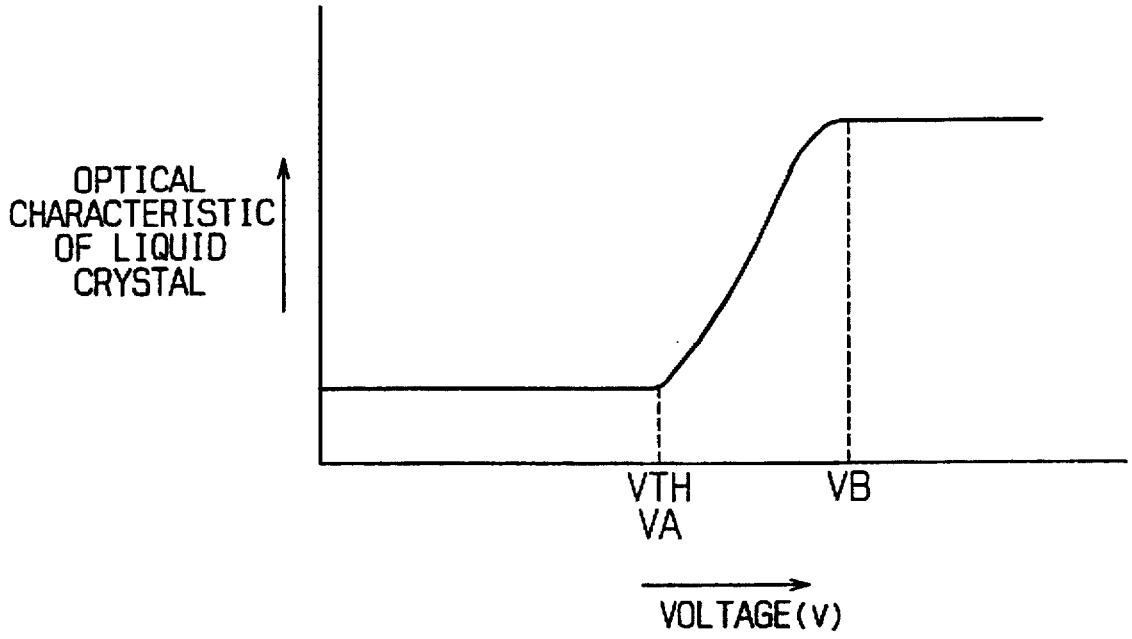
FIG. 26 Prior Art
FIG. 26 is a graph showing an optical characteristic of liquid crystal member 5.
Figure 27:
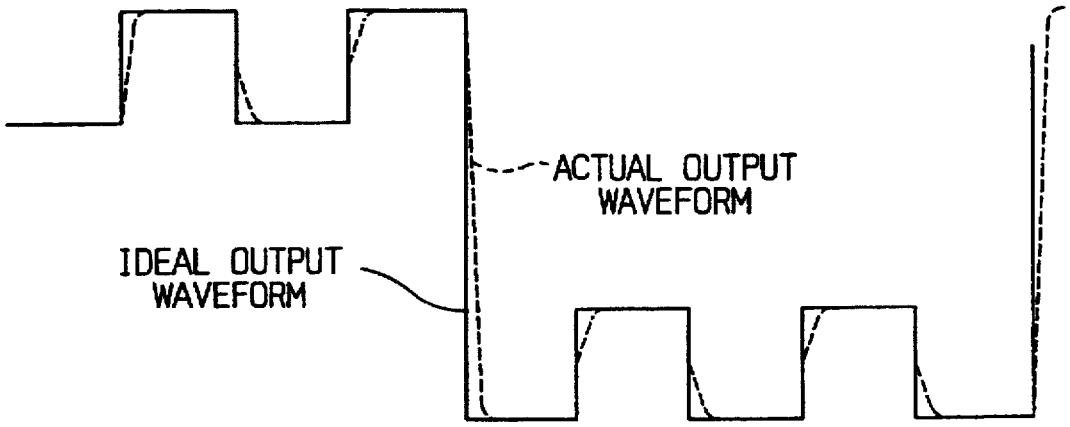
FIG. 27 Prior Art
FIG. 27 is a waveform diagram comparing an actual output waveform and an ideal output waveform when driving the liquid crystal display panel 1.

FIG. 16 is a block diagram of a general structure of a liquid crystal driving device in a sixth embodiment of the invention, and FIG. 17 is a block diagram of a general structure of a liquid crystal driving device in a seventh embodiment of the invention, and FIG. 18 is a block diagram of a general structure of a liquid crystal driving device in an eighth embodiment of the invention. In each embodiment, same constituent elements as in, for example, the first embodiment, are identified with same reference numerals, and explanations are omitted.

Figure 28:
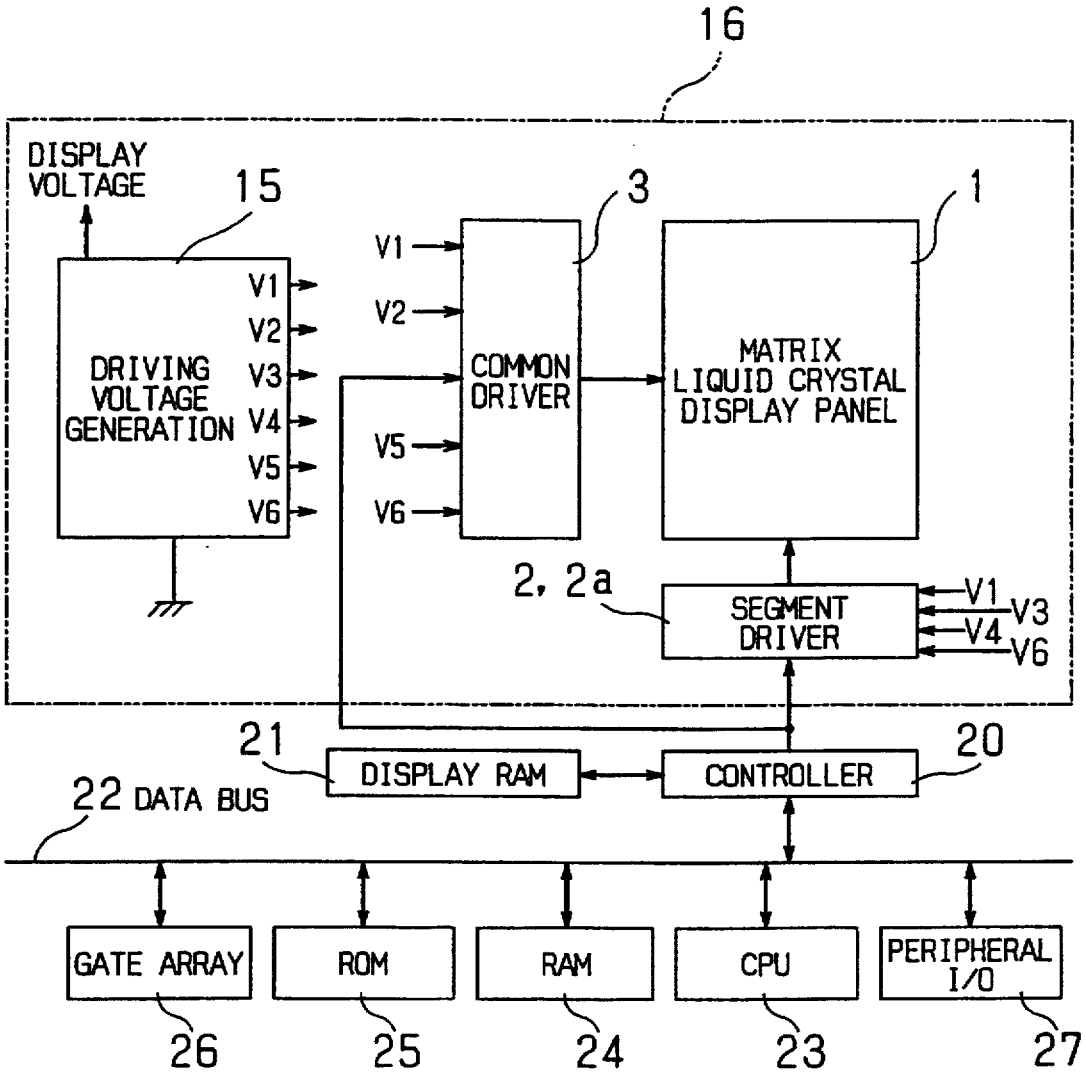
FIG. 28 Prior Art
FIG. 28 is a block diagram showing a typical electric structure for making gradation display on the liquid crystal display panel 1.

Segment drivers 88, 89, 90 in the embodiments are each provided with the two different output voltages VS1, VS2. As mentioned above, since the voltages VS1, VS2 are set to be low, it is not required to form as semiconductor integrated circuits by high withstand voltage process, and display RAM, CPU or gate array are incorporated so as to further enhance the degree of integration. In the sixth, seventh and eighth embodiments, corresponding to the prior art shown in FIG. 28, display RAM 91, data bus 92, CPU 93, RAM 94, ROM 95, gate array 96, and peripheral I/O 97 are provided, and some of them are incorporated in the segment drivers 88, 89, 90.

In the sixth embodiment shown in FIG. 16, since the display RAM is incorporated in the segment driver 88, the display RAM data for display can be read out and displayed at high speed according to the display timing. Besides, external wiring for display RAM is not needed, and the entire display device system is reduced in size.

In the seventh embodiment shown in FIG. 17, since the segment driver 89 incorporates the CPU, the gradation display and others can be controlled, and the control for determining the display data as required may be effected efficiently.

In the eighth embodiment shown in FIG. 18, since the segment driver 90 incorporates the gate array, the segment driver 90 of the composition including the function required by the user can be easily realized. By including the gate array in the structure, the segment driver 90 can be controlled by the gate array, without having to operate the program by the CPU 93 to control the segment driver 90, and signals are not exchanged through the data bus 92, so that the display speed can be enhanced.

Thus, according to the sixth to eighth embodiments of the invention, the liquid crystal driving voltage of the segment side can be lowered, and the segment drivers 88 to 90 can be structured in a low withstand voltage process, and therefore the segment drivers 88 to 90 can be integrated to a large scale as semiconductor integrated circuits, and moreover by manufacturing by a logic system process, part of the peripheral circuits can be easily incorporated into the segment drivers 88 to 90. As a result, the number of elements in the semiconductor integrated circuits for composing the gradation display system can be curtailed, the number of signals for interconnecting the semiconductor integrated circuits can be decreased, and the number of times of signal transfer is reduced, so that the system may be smaller in size, higher in speed, smaller in power consumption, and lower in price.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A liquid crystal driving device for driving liquid crystal of a simple matrix type liquid crystal display panel having segment side and common side electrodes disposed in two directions orthogonal to each other, by time sharing average voltage method using a semiconductor integrated circuit, comprising:

a low voltage driving circuit for driving electrodes arranged in one direction on the basis of two predetermined different voltages VS1, VS2, a high voltage driving circuit for driving electrodes arranged in another direction on the basis of three predetermined different voltages VC1, VC2, VC3, wherein the voltages VC1, VC3 are respectively the highest and the lowest among the three voltages VC1, VC2, VC3, and the absolute value of potential difference of the highest voltage VC1 and the lowest voltage VC3 is greater than the absolute value of potential difference of the two voltages VS1, VS2, and the intermediate voltage VC2 is set as a voltage between the two voltages VS1 and VS2, and a modulation circuit for modulating the output voltage waveform from the low voltage driving circuit according to a signal for gradation display.

2. The liquid crystal driving device of claim 1, wherein the two voltages VS1, VS2 are set in a range between a supply voltage VDD and a grounding voltage GND of a standard logic semiconductor integrated circuit element.

3. The liquid crystal driving device of claim 1, wherein the low voltage driving circuit drives the segment side electrodes, and the high voltage driving circuit drives the common side electrodes.

4. The liquid crystal driving device of claim 2, wherein the low voltage driving circuit is formed to include a display memory for temporarily storing the gradation display signal for making gradation display on the display panel.

5. The liquid crystal driving device of claim 2, wherein the low voltage driving circuit is formed to include a processing device for controlling the low and high voltage driving circuits.

6. The liquid crystal driving device of claim 2, wherein the low voltage driving circuit is formed to include a gate array formed of semiconductor elements for performing a predetermined function.

7. A liquid crystal driving device for driving liquid crystal of a simple matrix type liquid crystal display panel having segment side and common side electrodes disposed in two directions orthogonal to each other, by time sharing average voltage method using a semiconductor integrated circuit, comprising:

a low voltage driving circuit for driving electrodes arranged in one direction on the basis of two predetermined different voltages VS1, VS2, a high voltage driving circuit for driving electrodes arranged in another direction on the basis of three predetermined different voltages VC1, VC2, VC3, wherein the voltages VC1, VC3 are respectively the highest and the lowest among the three voltages VC1, VC2, VC3, and the absolute value of potential difference of the highest voltage VC1 and the lowest voltage VC3 is greater than the absolute value of potential difference of the two voltages VS1, VS2, and the intermediate voltage VC2 is set as a voltage between the two voltages VS1 and VS2, and a modulation circuit for modulating the output voltage waveform from the low voltage driving circuit according to a signal for gradation display, wherein the modulation circuit modulates the output voltage waveform in pulse width.

8. The liquid crystal driving device of claim 7, wherein the modulation circuit comprises:

pulse signal generating means for generating pulse signals of different widths in the same number as the maximum number of gradations that can be specified by the gradation display signal, pulse signal selecting means for selecting a pulse signal of the width corresponding to a gradation specified by the gradation display signal, and output means for outputting the voltages VS1, VS2 on the basis of a pulse signal selected by the pulse signal selecting means.

9. A liquid crystal driving device for driving liquid crystal of a simple matrix type liquid crystal display panel having segment side and common side electrodes disposed in two directions orthogonal to each other, by time sharing average voltage method using a semiconductor integrated circuit, comprising:

a low voltage driving circuit for driving electrodes arranged in one direction on the basis of two predetermined different voltages VS1, VS2, a high voltage driving circuit for driving electrodes arranged in another direction on the basis of three predetermined different voltages VC1, VC2, VC3, wherein the voltages VC1, VC3 are respectively the highest and the lowest among the three voltages VC1, VC2, VC3, and the absolute value of potential difference of the highest voltage VC1 and the lowest voltage VC3 is greater than the absolute value of potential difference of the two voltages VS1, VS2, and the intermediate voltage VC2 is set as a voltage between the two voltages VS1 and VS2, and a modulation circuit for modulating the output voltage waveform from the low voltage driving circuit according to a signal for gradation display, wherein the modulation circuit modulates the output voltage waveform in amplitude.

10. The liquid crystal driving device of claim 9, wherein the modulation circuit comprises:

voltage generating means for dividing from the voltage VS1 to the voltage VS2 by predetermined rates, and generating voltages of different widths in the same number as the maximum number of gradations that can be specified by the gradation display signal, and voltage selecting means for selecting and outputting a voltage of a width corresponding to the gradation specified by the gradation display signal.

11. A liquid crystal driving device for driving liquid crystal of a simple matrix type liquid crystal display panel having segment side and common side electrodes disposed in two directions orthogonal to each other, by time sharing average voltage method using a semiconductor integrated circuit, comprising:

a low voltage driving circuit for driving electrodes arranged in one direction on the basis of two predetermined different voltages VS1, VS2, a high voltage driving circuit for driving electrodes arranged in another direction on the basis of three predetermined different voltages VC1, VC2, VC3, wherein the voltages VC1, VC3 are respectively the highest and the lowest among the three voltages VC1, VC2, VC3, and the absolute value of potential difference of the highest voltage VC1 and the lowest voltage VC3 is greater than the absolute value of potential difference of the two voltages VS1, VS2, and the intermediate voltage VC2 is set as a voltage between the two voltages VS1 and VS2, and a modulation circuit for modulating the output voltage waveform from the low voltage driving circuit according to a signal for gradation display, wherein the modulation circuit modulates the output voltage waveform by a method of adjusting the number of pulses as a set of pulses.

12. The liquid crystal driving device of claim 11, wherein the modulation circuit comprises:

pulse signal output means for outputting pulse signals of a predetermined width in the same number as the maximum number of gradations that can be specified by the gradation display signal, in a frame period necessary for applying predetermined voltages sequentially to all of the electrodes arranged in one direction in the display panel, and output means for selecting pulse signals in the same number as the number of gradations specified by the gradation display signal, out of the pulse signals outputted from the pulse signal output means in the frame period, outputting either one of the voltages VS1, VS2 in the periods of the predetermined width of the pulse signals, and outputting the other voltage in other periods than the predetermined width of the pulse signals.

13. A liquid crystal driving device for driving liquid crystal of a simple matrix type liquid crystal display panel having segment side and common side electrodes disposed in two directions orthogonal to each other, by time sharing average voltage method using a semiconductor integrated circuit, comprising:

a low voltage driving circuit for driving electrodes arranged in one direction on the basis of two predetermined different voltages VS1, VS2, a high voltage driving circuit for driving electrodes arranged in another direction on the basis of three predetermined different voltages VC1, VC2, VC3, wherein the voltages VC1, VC3 are respectively the highest and the lowest among the three voltages VC1, VC2, VC3, and the absolute value of potential difference of the highest voltage VC1 and the lowest voltage VC3 is greater than the absolute value of potential difference of the two voltages VS1, VS2, and the intermediate voltage VC2 is set as a voltage between the two voltages VS1 and VS2, and a modulation circuit for modulating the output voltage waveform from the low voltage driving circuit according to a signal for gradation display, wherein the modulation circuit modulates the output voltage waveform by frame decimation method.

14. The liquid crystal driving device of claim 13, wherein the modulation circuit comprises:

voltage output means for outputting either one of the voltages VS1, VS2 in every frame period necessary for applying predetermined voltages sequentially to all of the electrodes arranged in one direction of the display panel, and output means for determining a reference frame period including a frame period in the same number as the maximum number of gradations that can be specified by the gradation display signal, and determining the voltage in each frame period within the reference frame period, on the basis of the number of gradations specified by the gradation display signal.

15. A liquid crystal driving device for driving liquid crystal of a simple matrix type liquid crystal display panel having segment side and common side electrodes disposed in two directions orthogonal to each other, by time sharing average voltage method using a semiconductor integrated circuit, comprising:

a low voltage driving circuit for driving electrodes arranged in one direction on the basis of two predetermined different voltages VS1, VS2, a high voltage driving circuit for driving electrodes arranged in another direction on the basis of three predetermined different voltages VC1, VC2, VC3, wherein the voltages VC1, VC3 are respectively the highest and the lowest among the three voltages VC1, VC2, VC3, and the absolute value of potential difference of the highest voltage VC1 and the lowest voltage VC3 is greater than the absolute value of potential difference of the two voltages VS1, VS2, and the intermediate voltage VC2 is set as a voltage between the two voltages VS1 and VS2, and a modulation circuit for modulating the output voltage waveform from the low voltage driving circuit according to a signal for gradation display, wherein the two voltages VS1, VS2 are set in a range between a supply voltage VDD and a grounding voltage GND of a standard logic semiconductor integrated circuit element; and the modulation circuit modulates the output voltage waveform in pulse width.

16. The liquid crystal driving device of claim 15, wherein the modulation circuit comprises:

pulse signal generating means for generating pulse signals of different widths in the same number as the maximum number of gradations that can be specified by the gradation display signal, pulse signal selecting means for selecting a pulse signal of the width corresponding to a gradation specified by the gradation display signal, and output means for outputting the voltages VS1, VS2 on the basis of a pulse signal selected by the pulse signal selecting means.

17. A liquid crystal driving device for driving liquid crystal of a simple matrix type liquid crystal display panel having segment side and common side electrodes disposed in two directions orthogonal to each other, by time sharing average voltage method using a semiconductor integrated circuit, comprising:

a low voltage driving circuit for driving electrodes arranged in one direction on the basis of two predetermined different voltages VS1, VS2, a high voltage driving circuit for driving electrodes arranged in another direction on the basis of three predetermined different voltages VC1, VC2, VC3, wherein the voltages VC1, VC3 are respectively the highest and the lowest among the three voltages VC1, VC2, VC3, and the absolute value of potential difference of the highest voltage VC1 and the lowest voltage VC3 is greater than the absolute value of potential difference of the two voltages VS1, VS2, and the intermediate voltage VC2 is set as a voltage between the two voltages VS1 and VS2, and a modulation circuit for modulating the output voltage waveform from the low voltage driving circuit according to a signal for gradation display, wherein the two voltages VS1, VS2 are set in a range between a supply voltage VDD and a grounding voltage GND of a standard logic semiconductor integrated circuit element, wherein the low voltage driving circuit drives the segment wherein the low voltage driving circuit drives the segment side electrodes, and the high voltage driving circuit drives the common side electrodes; and the modulation circuit modulates the output voltage waveform in pulse width.

18. The liquid crystal driving device of claim 17, wherein the modulation circuit comprises:

pulse signal generating means for generating pulse signals of different widths in the same number as the maximum number of gradations that can be specified by the gradation display signal, pulse signal selecting means for selecting a pulse signal of the width corresponding to a gradation specified by the gradation display signal, and output means for outputting the voltages VS1, VS2 on the basis of a pulse signal selected by the pulse signal selecting means.

19. A liquid crystal driving device for driving liquid crystal of a simple matrix type liquid crystal display panel having segment side and common side electrodes disposed in two directions orthogonal to each other, by time sharing average voltage method using a semiconductor integrated circuit, comprising:

a low voltage driving circuit for driving electrodes arranged in one direction on the basis of two predetermined different voltages VS1, VS2, a high voltage driving circuit for driving electrodes arranged in another direction on the basis of three predetermined different voltages VC1, VC2, VC3, wherein the voltages VC1, VC3 are respectively the highest and the lowest among the three voltages VC1, VC2, VC3, and the absolute value of potential difference of the highest voltage VC1 and the lowest voltage VC3 is greater than the absolute value of potential difference of the two voltages VS1, VS2, and the intermediate voltage VC2 is set as a voltage between the two voltages VS1 and VS2, and a modulation circuit for modulating the output voltage waveform from the low voltage driving circuit according to a signal for gradation display, wherein the two voltages VS1, VS2 are set in a range between a supply voltage VDD and a grounding voltage GND of a standard logic semiconductor integrated circuit element, the modulation circuit modulates the output voltage waveform in pulse width; and wherein the modulation circuit modulates the output voltage waveform in amplitude.

20. The liquid crystal driving device of claim 19, wherein the modulation circuit comprises:

voltage generating means for dividing from the voltage VS1 to the voltage VS2 by predetermined rates, and generating voltages of different widths in the same number as the maximum number of gradations that can be specified by the gradation display signal, and voltage selecting means for selecting and outputting a voltage of a width corresponding to the gradation specified by the gradation display signal.

21. A liquid crystal driving device for driving liquid crystal of a simple matrix type liquid crystal display panel having segment side and common side electrodes disposed in two directions orthogonal to each other, by time sharing average voltage method using a semiconductor integrated circuit, comprising:

a low voltage driving circuit for driving electrodes arranged in one direction on the basis of two predetermined different voltages VS1, VS2, a high voltage driving circuit for driving electrodes arranged in another direction on the basis of three predetermined different voltages VC1, VC2, VC3, wherein the voltages VC1, VC3 are respectively the highest and the lowest among the three voltages VC1, VC2, VC3, and the absolute value of potential difference of the highest voltage VC1 and the lowest voltage VC3 is greater than the absolute value of potential difference of the two voltages VS1, VS2, and the intermediate voltage VC2 is set as a voltage between the two voltages VS1 and VS2, and a modulation circuit for modulating the output voltage waveform from the low voltage driving circuit according to a signal for gradation display, wherein the two voltages VS1, VS2 are set in a range between a supply voltage VDD and a grounding voltage GND of a standard logic semiconductor integrated circuit element, wherein the low voltage driving circuit drives the segment wherein the low voltage driving circuit drives the segment side electrodes, and the high voltage driving circuit drives the common side electrodes; and wherein the modulation circuit modulates the output voltage waveform in amplitude.

22. The liquid crystal driving device of claim 21, wherein the modulation circuit comprises:

voltage generating means for dividing from the voltage VS1 to the voltage VS2 by predetermined rates, and generating voltages of different widths in the same number as the maximum number of gradations that can be specified by the gradation display signal, and voltage selecting means for selecting and outputting a voltage of a width corresponding to the gradation specified by the gradation display signal.

23. A liquid crystal driving device for driving liquid crystal of a simple matrix type liquid crystal display panel having segment side and common side electrodes disposed in two directions orthogonal to each other, by time sharing average voltage method using a semiconductor integrated circuit, comprising:

a low voltage driving circuit for driving electrodes arranged in one direction on the basis of two predetermined different voltages VS1, VS2, a high voltage driving circuit for driving electrodes arranged in another direction on the basis of three predetermined different voltages VC1, VC2, VC3, wherein the voltages VC1, VC3 are respectively the highest and the lowest among the three voltages VC1, VC2, VC3, and the absolute value of potential difference of the highest voltage VC1 and the lowest voltage VC3 is greater than the absolute value of potential difference of the two voltages VS1, VS2, and the intermediate voltage VC2 is set as a voltage between the two voltages VS1 and VS2, and a modulation circuit for modulating the output voltage waveform from the low voltage driving circuit according to a signal for gradation display, wherein the two voltages VS1, VS2 are set in a range between a supply voltage VDD and a grounding voltage GND of a standard logic semiconductor integrated circuit element; and the modulation circuit modulates the output voltage waveform in pulse width; and wherein the modulation circuit modulates the output voltage waveform by a method of adjusting the number of pulses as a set of pulses.

24. The liquid crystal driving device of claim 23, wherein the modulation circuit comprises:

pulse signal output means for outputting pulse signals of a predetermined width in the same number as the maximum number of gradations that can be specified by the gradation display signal, in a frame period necessary for applying predetermined voltages sequentially to all of the electrodes arranged in one direction in the display panel, and output means for selecting pulse signals in the same number as the number of gradations specified by the gradation display signal, out of the pulse signals outputted from the pulse signal output means in the frame period, outputting either one of the voltages VS1, VS2 in the periods of the predetermined width of the pulse signals, and outputting the other voltage in other periods than the predetermined width of the pulse signals.

25. A liquid crystal driving device for driving liquid crystal of a simple matrix type liquid crystal display panel having segment side and common side electrodes disposed in two directions orthogonal to each other, by time sharing average voltage method using a semiconductor integrated circuit, comprising:

a low voltage driving circuit for driving electrodes arranged in one direction on the basis of two predetermined different voltages VS1, VS2, a high voltage driving circuit for driving electrodes arranged in another direction on the basis of three predetermined different voltages VC1, VC2, VC3, wherein the voltages VC1, VC3 are respectively the highest and the lowest among the three voltages VC1, VC2, VC3, and the absolute value of potential difference of the highest voltage VC1 and the lowest voltage VC3 is greater than the absolute value of potential difference of the two voltages VS1, VS2, and the intermediate voltage VC2 is set as a voltage between the two voltages VS1 and VS2, and a modulation circuit for modulating the output voltage waveform from the low voltage driving circuit according to a signal for gradation display, wherein the two voltages VS1, VS2 are set in a range between a supply voltage VDD and a grounding voltage GND of a standard logic semiconductor integrated circuit element, wherein the low voltage driving circuit drives the segment wherein the low voltage driving circuit drives the segment side electrodes, and the high voltage driving circuit drives the common side electrodes; and wherein the modulation circuit modulates the output voltage waveform by a method of adjusting the number of pulses as a set of pulses.

26. The liquid crystal driving device of claim 25, wherein the modulation circuit comprises:

pulse signal output means for outputting pulse signals of a predetermined width in the same number as the maximum number of gradations that can be specified by the gradation display signal, in a frame period necessary for applying predetermined voltages sequentially to all of the electrodes arranged in one direction in the display panel, and output means for selecting pulse signals in the same number as the number of gradations specified by the gradation display signal, out of the pulse signals outputted from the pulse signal output means in the frame period, outputting either one of the voltages VS1, VS2 in the periods of the predetermined width of the pulse signals, and outputting the other voltage in other periods than the predetermined width of the pulse signals.

27. A liquid crystal driving device for driving liquid crystal of a simple matrix type liquid crystal display panel having segment side and common side electrodes disposed in two directions orthogonal to each other, by time sharing average voltage method using a semiconductor integrated circuit, comprising:

a low voltage driving circuit for driving electrodes arranged in one direction on the basis of two predetermined different voltages VS1, VS2, a high voltage driving circuit for driving electrodes arranged in another direction on the basis of three predetermined different voltages VC1, VC2, VC3, wherein the voltages VC1, VC3 are respectively the highest and the lowest among the three voltages VC1, VC2, VC3, and the absolute value of potential difference of the highest voltage VC1 and the lowest voltage VC3 is greater than the absolute value of potential difference of the two voltages VS1, VS2, and the intermediate voltage VC2 is set as a voltage between the two voltages VS1 and VS2, and a modulation circuit for modulating the output voltage waveform from the low voltage driving circuit according to a signal for gradation display, wherein the two voltages VS1, VS2 are set in a range between a supply voltage VDD and a grounding voltage GND of a standard logic semiconductor integrated circuit element, the modulation circuit modulates the output voltage waveform in pulse width; and wherein the modulation circuit modulates the output voltage waveform by frame decimation method.

28. The liquid crystal driving device of claim 27, wherein the modulation circuit comprises:

voltage output means for outputting either one of the voltages VS1, VS2 in every frame period necessary for applying predetermined voltages sequentially to all of the electrodes arranged in one direction of the display panel, and output means for determining a reference frame period including a frame period in the same number as the maximum number of gradations that can be specified by the gradation display signal, and determining the voltage in each frame period within the reference frame period, on the basis of the number of gradations specified by the gradation display signal.

29. A liquid crystal driving device for driving liquid crystal of a simple matrix type liquid crystal display panel having segment side and common side electrodes disposed in two directions orthogonal to each other, by time sharing average voltage method using a semiconductor integrated circuit, comprising:

a low voltage driving circuit for driving electrodes arranged in one direction on the basis of two predetermined different voltages VS1, VS2, a high voltage driving circuit for driving electrodes arranged in another direction on the basis of three predetermined different voltages VC1, VC2, VC3, wherein the voltages VC1, VC3 are respectively the highest and the lowest among the three voltages VC1, VC2, VC3, and the absolute value of potential difference of the highest voltage VC1 and the lowest voltage VC3 is greater than the absolute value of potential difference of the two voltages VS1, VS2, and the intermediate voltage VC2 is set as a voltage between the two voltages VS1 and VS2, and a modulation circuit for modulating the output voltage waveform from the low voltage driving circuit according to a signal for gradation display, wherein the two voltages VS1, VS2 are set in a range between a supply voltage VDD and a grounding voltage GND of a standard logic semiconductor integrated circuit element, wherein the low voltage driving circuit drives the segment wherein the low voltage driving circuit drives the segment side electrodes, and the high voltage driving circuit drives the common side electrodes; and wherein the modulation circuit modulates the output voltage waveform by frame decimation method.

30. The liquid crystal driving device of claim 29, wherein the modulation circuit comprises:

voltage output means for outputting either one of the voltages VS1, VS2 in every frame period necessary for applying predetermined voltages sequentially to all of the electrodes arranged in one direction of the display panel, and output means for determining a reference frame period including a frame period in the same number as the maximum number of gradations that can be specified by the gradation display signal, and determining the voltage in each frame period within the reference frame period, on the basis of the number of gradations specified by the gradation display signal.

* * * * *